US012023781B2

(12) United States Patent
Tatematsu

(10) Patent No.: US 12,023,781 B2
(45) Date of Patent: Jul. 2, 2024

(54) SHOT PROCESSING APPARATUS

(71) Applicant: Sintokogio, Ltd., Nagoya (JP)

(72) Inventor: Ryo Tatematsu, Toyokawa (JP)

(73) Assignee: Sintokogio, Ltd., Nagoya (JP)

( * ) Notice: Subject to any disclaimer, the term of this patent is extended or adjusted under 35 U.S.C. 154(b) by 1016 days.

(21) Appl. No.: 16/963,456

(22) PCT Filed: Mar. 19, 2019

(86) PCT No.: PCT/JP2019/011555
§ 371 (c)(1),
(2) Date: Jul. 20, 2020

(87) PCT Pub. No.: WO2019/188610
PCT Pub. Date: Oct. 3, 2019

(65) Prior Publication Data

US 2020/0384609 A1 Dec. 10, 2020

(30) Foreign Application Priority Data

Mar. 26, 2018 (JP) ..... 2018-058023

(51) Int. Cl.
*B24C 9/00* (2006.01)
*B24C 3/04* (2006.01)
(Continued)

(52) U.S. Cl.
CPC ..... *B24C 9/00* (2013.01); *B24C 3/12* (2013.01); *B24C 3/04* (2013.01)

(58) Field of Classification Search
None
See application file for complete search history.

(56) References Cited

U.S. PATENT DOCUMENTS 7,421,872 B2 * 9/2008 Indlekofer ..... B24C 3/14 29/90.7
9,205,992 B2 * 12/2015 Otto ..... B65G 47/61
(Continued)

FOREIGN PATENT DOCUMENTS

CN 103309305 A 9/2013
CN 107471122 A 12/2017
(Continued)

OTHER PUBLICATIONS

Chinese First Office Action, The State Intellectual Property Office of People's Republic of China, Chinese Application No. 201980010226.0, Feb. 24, 2022., 8 pages.
(Continued)

*Primary Examiner* — Kavel Singh
(74) *Attorney, Agent, or Firm* — Taft Stettinius & Hollister LLP

(57) ABSTRACT

A shot processing apparatus in which a projection machine projects projection media onto a workpiece. The shot processing apparatus includes plural hanger transport devices and a control unit. The hanger transport devices are each, in a hanging state of a member on which a workpiece is set or a hanging state of a workpiece, capable of moving along a guide path inside the shot processing apparatus and capable of stopping. The hanger transport devices are also capable of providing self-identifying identification information. The control unit controls the hanger transport devices by outputting to each of the plural hanger transport devices a control signal appropriate to each of the hanger transport devices. This control is based on the identification information provided from each of the individual hanger transport devices and based on information related to each of the individual hanger transport devices stored in advance in association with the identification information.

10 Claims, 17 Drawing Sheets

(51) Int. Cl.

| | |
|---|---|
| ***B24C 3/12*** | (2006.01) |
| ***B65G 17/20*** | (2006.01) |
| ***B65G 17/32*** | (2006.01) |
| ***B65G 17/48*** | (2006.01) |
| ***B65G 43/00*** | (2006.01) |

(56) References Cited

U.S. PATENT DOCUMENTS

| | | | | |
|---|---|---|---|---|
| 10,300,580 | B2 * | 5/2019 | Yamamoto | B24C 1/10 |
| 11,167,392 | B2 * | 11/2021 | Tatematsu | B24C 3/10 |

FOREIGN PATENT DOCUMENTS

| | | | |
|---|---|---|---|
| JP | S57197458 | U | 12/1982 |
| JP | S58027058 | U | 2/1983 |
| JP | 4354633 | A | 12/1992 |
| JP | 976158 | A | 3/1997 |
| JP | 2744689 | B2 | 4/1998 |

OTHER PUBLICATIONS

International Search Report, Japan Patent Office, International Application No. PCT/JP2019/011555, May 21, 2019, 2 pages.
Written Opinion of the International Searching Authority, Japan Patent Office, International Application No. PCT/JP2019/011555, May 21, 2019, 3 pages.

* cited by examiner

SHOT PROCESSING APPARATUS

CROSS-REFERENCE TO RELATED APPLICATIONS

This application is a U.S. National Phase Application of International Patent Application No. PCT/JP2019/011555, which was filed on Mar. 19, 2019, and which claims the benefit of, and priority to, Japanese Patent Application No. 2018-058023, which was filed on Mar. 26, 2018. The contents of each application are incorporated herein by reference in their entirety.

TECHNICAL FIELD

The present disclosure relates to a shot processing apparatus.

BACKGROUND ART

A shot blasting treatment apparatus is known in which a workpiece is transported while hanging from a hanger transport device, and the workpiece is conveyed into a projection chamber at which blasting treatment is performed thereon by a projection machine (see, for example, Japanese Utility Model Application Laid-Open Nos. S57-197458 and S58-27058). Among such apparatuses there are also apparatuses provided with plural hanger transport devices, with each of the hanger transport devices self-propelled.

SUMMARY OF INVENTION

Technical Problem

However, there is room for improvement in such shot blasting treatment apparatuses since blasting treatment being performed thereon does not consider individual differences between hanger transport devices.

In consideration of the above circumstances, an exemplary embodiment of the present invention is to provide a shot processing apparatus capable of processing appropriate to individual differences between hanger transport devices.

Solution to Problem

A first aspect of the present invention is a shot processing apparatus for projecting projection media onto a workpiece by a projection machine. The shot processing apparatus includes plural hanger transport devices and a control unit. The hanger transport devices are each, in a hanging state of a member on which a workpiece is set or a hanging state of a workpiece, is movable along a guide path inside the shot processing apparatus and is stoppable. The hanger transport devices is configured to provide self-specifying identification information. The control unit controls operation of the hanger transport devices by outputting, to each of the plural hanger transport device, a control signal appropriate to each of the hanger transport devices. This control is based on the identification information provided from each of the individual hanger transport devices, and based on information related to each of the individual hanger transport devices stored in advance in association with the identification information.

In the shot processing apparatus of the first aspect, the control unit controls operation of the hanger transport devices by outputting, to each of the plural hanger transport devices, a control signal appropriate to each of the hanger transport devices based on the identification information (the information provided from each of the individual hanger transport devices) and based on the information related to the individual hanger transport devices (the information stored in advance in association with the identification information). This accordingly enables control to be performed for each of the individual hanger transport devices such that operation is appropriate to the individual hanger transport device.

A second aspect of the present invention is also a shot processing apparatus for projecting projection media onto a workpiece by a projection machine. The shot processing apparatus includes plural hanger transport devices, a robot, and a control unit. The hanger transport devices are, in a hanging state of a member on which a workpiece is set or a hanging state of a workpiece, movable along a guide path inside the shot processing apparatus and are stoppable. The hanger transport devices are configured to provide self-specifying identification information. The robot is provided separately from the hanger transport devices and performs a task in a process for shot processing. The control unit controls operation of the robot by outputting to the robot an operation that is appropriate for each of the plural hanger transport devices. The control is based on the identification information provided from each of the individual hanger transport devices and is based on information related to each of the individual hanger transport devices stored in advance in association with the identification information. Note that the definition of the "process for shot processing" includes a projection process in which projection media is projected onto a workpiece, also includes a process executed prior to a projection process and a process executed after the projection process in a chain of processes for shot processing.

In the shot processing apparatus of the second aspect, the control unit controls the operation of the robot by outputting to the robot an operation signal that is appropriate for each of the plural hanger transport devices based on the identification information provided from each of the individual hanger transport devices and based on information related to each of the individual hanger transport devices stored in advance in association with the identification information. This accordingly enables the operation of the robot to be controlled so as to execute a task in an appropriate manner for each of the individual hanger transport devices.

A shot processing apparatus of a third aspect of the present invention may be configured by the shot processing apparatus of the second aspect, wherein the robot includes a transfer robot to perform at least workpiece loading or workpiece unloading at a transfer station. At the transfer station the hanger transport device is stopped and the workpiece loading or the workpiece unloading is performed.

In the shot processing apparatus of the third aspect, the control unit controls operation of the transfer robot by outputting an operation signal to the transfer robot that is appropriate for each of the hanger transport devices based on the identification information provided from the individual hanger transport devices and based on information related to the hanger transport devices stored in advance in association with the identification information. This thereby enables operation of the transfer robot to be controlled so as to execute at least the workpiece loading or the workpiece unloading specifically for each of the individual hanger transport devices.

A shot processing apparatus of a fourth aspect of the present invention may be configured by the shot processing apparatus of the second aspect or the third aspect, wherein the projection machine is an air pressure projection machine in which air that has been pressurized is mixed with projection media and the mixture is ejected from a nozzle. The robot includes a nozzle holding robot that holds the nozzle and moves a leading end of the nozzle toward the workpiece.

In the shot processing apparatus of the fourth aspect, the control unit controls the operation of the nozzle holding robot by outputting to the nozzle holding robot an operation signal that is appropriate to each of the hanger transport devices based on the identification information provided from hanger transport device and based on the information related to the hanger transport device stored in advance in association with the identification information. This thereby enables the nozzle holding robot to be controlled so as to perform an operation in an appropriate manner for each of the individual hanger transport devices.

A shot processing apparatus of a fifth aspect of the present invention may be the shot processing apparatus of any one of the first aspect to the fourth aspect, wherein the hanger transport devices are movable along the guide path while in a hanging state of a work set jig including a frame body for accommodating a workpiece. The guide path includes a curved path that is curved in apparatus plan view. The shot processing apparatus is also equipped with a rail-shaped guide section that is separate from the guide path and that is provided along a part of a transport path along which a workpiece is transported by movement of the hanger transport devices. The work set jig includes a guided section that is guided by the guide section. The rail-shaped guide section includes a left and right pair of stopping area guide sections that have an entrance corresponding to a terminal end side of the curved path in apparatus plan view and the stopping area guide sections are disposed over a range including a stopping position of the work set jig. The control unit is configured to set a movement velocity of the hanger transport devices at a timing at which the hanger transport devices have been detected by a detection member as passing in a vicinity of a placement position of the detection member. The detection member is arranged in a vicinity of a start end side of the curved path in apparatus plan view. The movement velocity is set such that the guided section is able to enter between the left and right pair of stopping area guide sections even in a case in which the work set jig sways under centrifugal force.

In the shot processing apparatus of the fifth aspect, the rail-shaped guide section separate from the guide path is provided along a part of the transport path. The hanger transport devices move along the guide path while in the hanging state of the work set jig including the frame body for accommodating a workpiece, and the guided section of the work set jig is guided by the guide section. This thereby enables a workpiece set inside the frame body of the work set jig to be transported more stably. Moreover, the guide path is equipped with a curved path that is curved in apparatus plan view, and the left and right pair of stopping area guide sections have the entrance corresponding to the terminal end side of the curved path in apparatus plan view. The left and right pair of stopping area guide sections are disposed over the range including the stopping position of the work set jig. When the hanger transport devices have been detected by the detection member as passing in the vicinity of the placement position of the detection member that is arranged in the vicinity of the start end side of the curved path in apparatus plan view, the movement velocity of the hanger transport devices is set by the control unit to a movement velocity that enables the guided section to enter between the left and right pair of stopping area guide sections even in a case in which the work set jig sways under centrifugal force. The workpiece is accordingly transported and stopped stably even if the curved path presents.

A shot processing apparatus of a sixth aspect of the present invention nay be the shot processing apparatus of the fifth aspect, wherein the detection member includes a first detection member, and the movement velocity set at the timing at which the hanger transport devices have been detected by the first detection member is a first movement velocity. The control unit is configured to set a movement velocity of the hanger transport devices to a second movement velocity at a timing at which the hanger transport devices have been detected by a second detection member as passing in a vicinity of a placement position of the second detection member. The second detection member is arranged at a transport direction upstream side of a station at which the hanger transport devices stop and at which the work set jig is positioned by a positioning mechanism. The second movement velocity is lower than the first movement velocity.

In the shot processing apparatus of the sixth aspect, the movement velocity of the hanger transport devices is set by the control unit to the second movement velocity at the timing at which the hanger transport devices have been detected by the second detection member as passing in the vicinity of the placement position of the second detection member. The second detection member is arranged at the transport direction upstream side of the station at which the hanger transport devices stop and at which the work set jig is positioned by the positioning mechanism. Moreover, the second movement velocity is lower than the first movement velocity. This accordingly enables a work set jig and a workpiece set inside the work set jig to be stopped with good precision when the hanger transport devices are being stopped.

A shot processing apparatus of a seventh aspect of the present invention may be the shot processing apparatus of the fifth aspect, wherein the detection member includes a first detection member, and the movement velocity set at the timing at which the hanger transport devices have been detected by the first detection member as passing in the vicinity of the placement position of the first detection member is a first movement velocity. The control unit is configured to set a movement velocity of the hanger transport devices to a second movement velocity at a timing at which the hanger transport devices have been detected by a second detection member as passing in a vicinity of a placement position of the second detection member. The second detection member is arranged so as to correspond to a transport direction upstream side of a straight line section of the transport path in apparatus plan view, the work set jig being transported in a state in which there is no workpiece set inside the work set jig at the straight line section. The second movement velocity is higher than the first movement velocity.

In the shot processing apparatus of the seventh aspect, the second detection member is arranged so as to correspond to the transport direction upstream side of the straight line section of the transport path in apparatus plan view, at which the work set jig is transported in a state in which there is no workpiece set inside the work set jig. The movement velocity of the hanger transport device is set by the control unit to the second movement velocity at the timing at which the hanger transport devices have been detected by the second detection member as passing in the vicinity of the placement position of the second detection member. The second movement velocity is higher than the first movement velocity. The cycle time is accordingly shortened.

As described above, the shot processing apparatus of an exemplary embodiment of the present invention exhibit the excellent advantageous effect of being able to perform processing appropriate to individual differences between each of the hanger transport devices.

DESCRIPTION OF EMBODIMENTS

Figure 1:
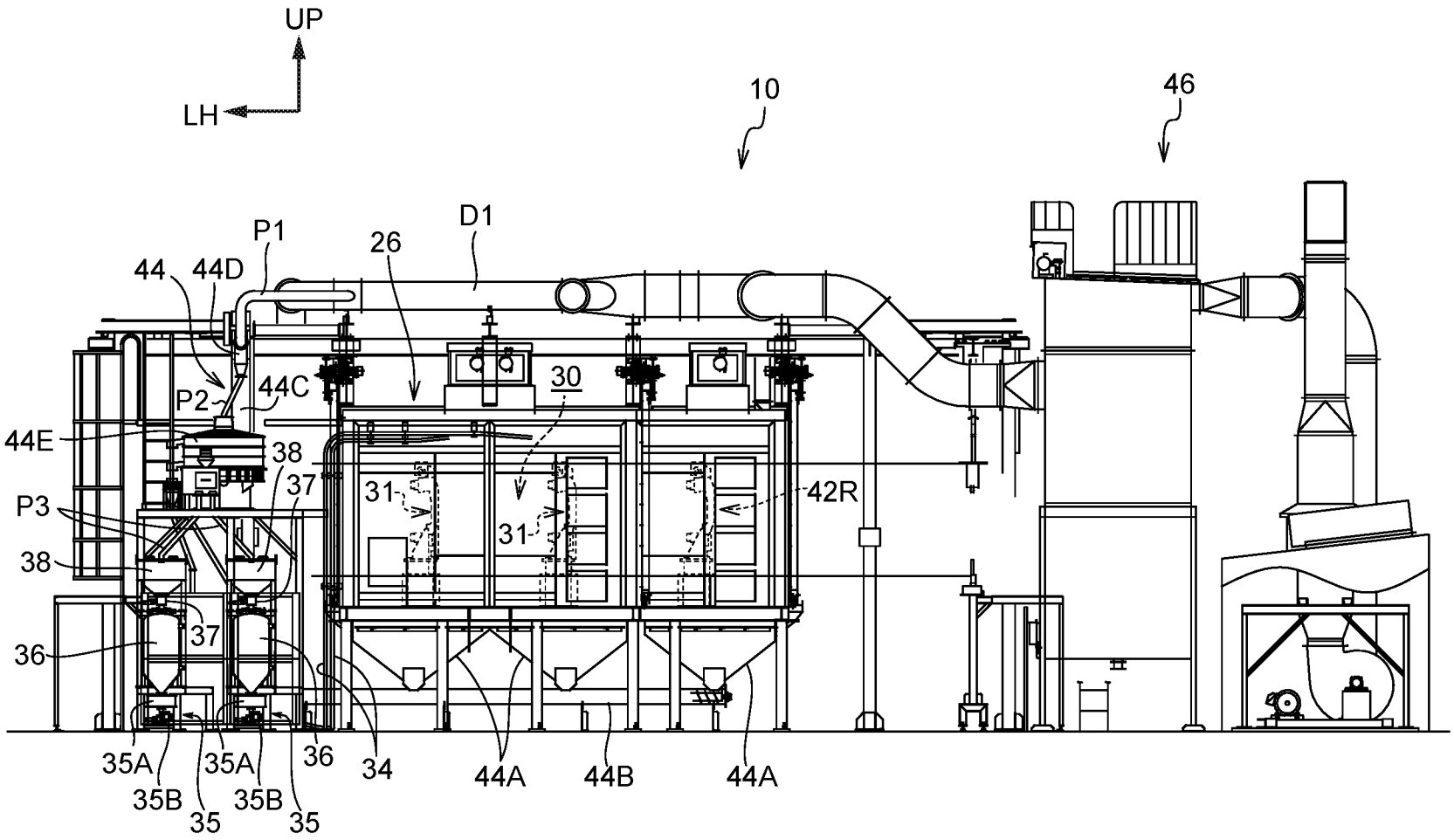
FIG. 1 illustrates a blasting treatment apparatus according to an exemplary embodiment of the present invention, in front face view.

Explanation follows regarding a blasting treatment apparatus serving as a shot processing apparatus according to an exemplary embodiment of the present invention, with reference to FIG. 1 to FIG. 13B. Note that as appropriate in the drawings, an arrow FR indicates the nearside in an apparatus front view of FIG. 1, an arrow UP indicates an apparatus upper side, and an arrow LH indicates a left side in the apparatus front view of FIG. 1. Moreover, an arrow X illustrates a transport direction of workpieces W.

Outline of Blasting Treatment Apparatus 10

An outline explanation first follows regarding the apparatus of the blasting treatment apparatus 10. The blasting treatment apparatus 10 according to the present exemplary embodiment is, for example, an apparatus applied to knock off dirt and the like from weld portions of a workpiece, and is configured with the capability to perform blasting treatment exclusively at particular locations without masking.

Figure 4:
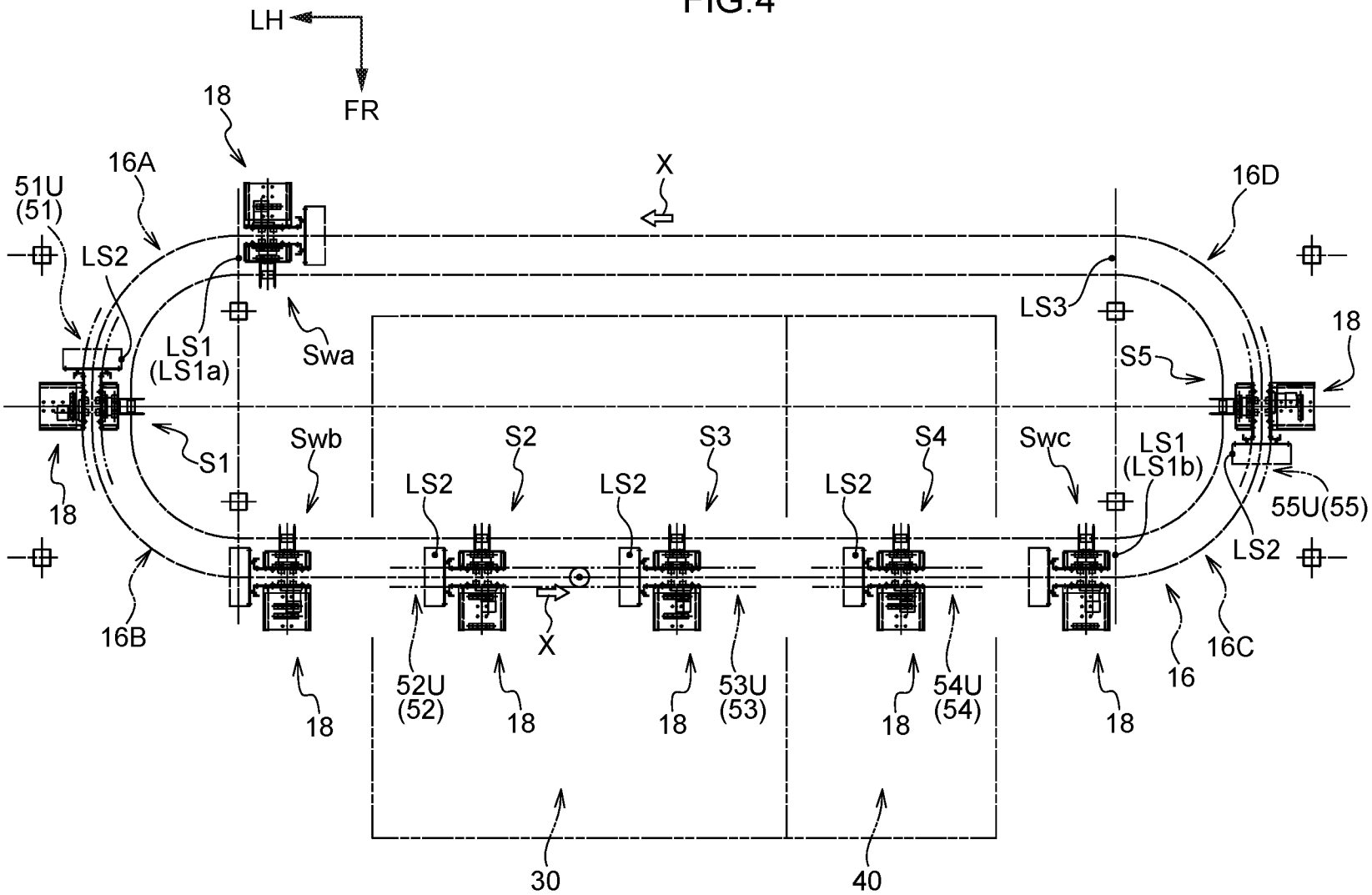
FIG. 4 is a plan view illustrating a guide path and stopping positions of hanger transport devices in the blasting treatment apparatus of FIG. 1.
Figure 5:
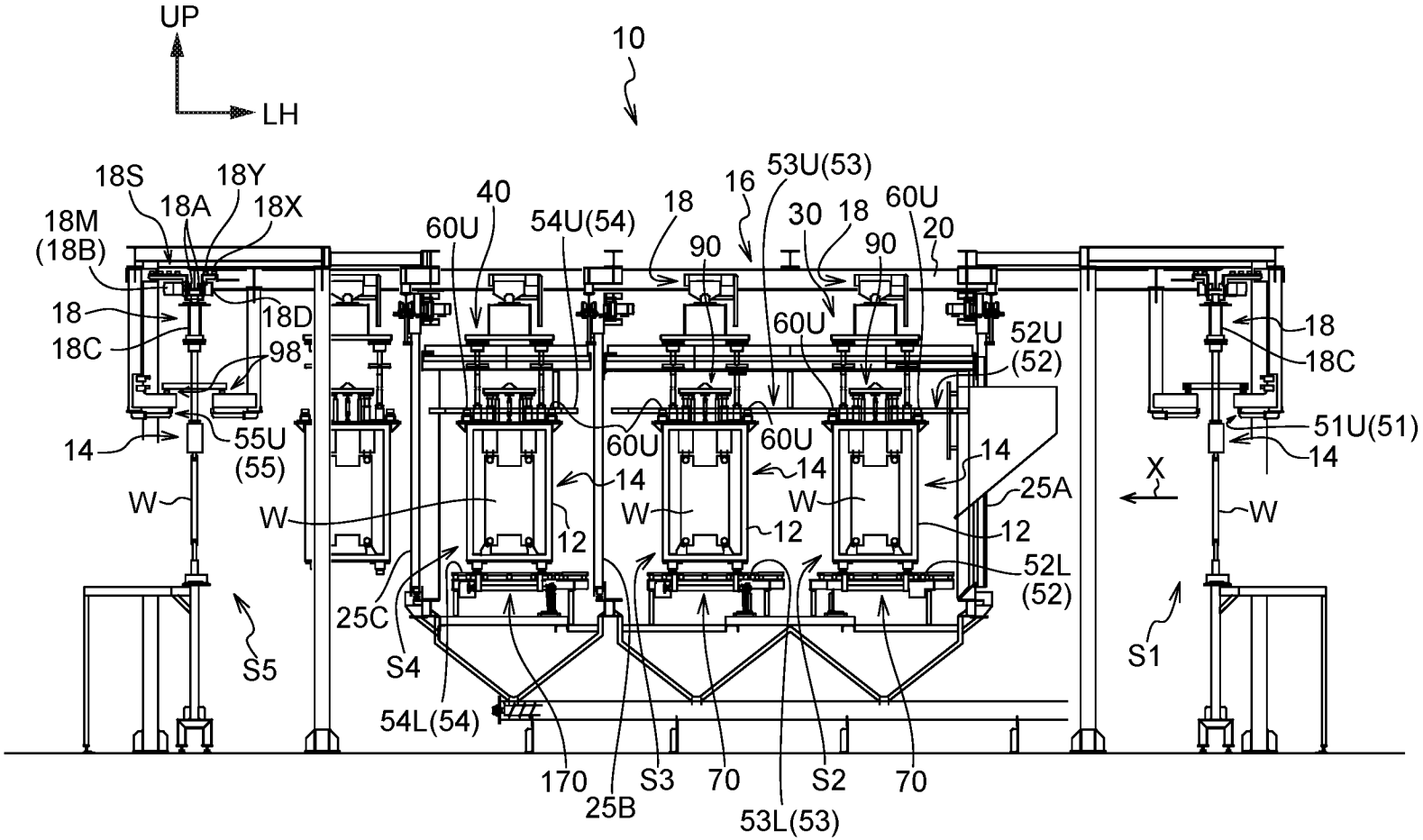
FIG. 5 is a diagram illustrating the blasting treatment apparatus of FIG. 1 sectioned in an apparatus left-right direction along shot processing positions, as viewed from an apparatus rear side.

As illustrated in FIG. 5, the blasting treatment apparatus 10 includes work set jigs 14, that are each equipped with a frame body 12 (base member) inside of which a workpiece W is set, and hanger transport devices 18 that are each capable of moving along a guide path 16 with the work set jig 14 in a hanging state, and stopping on the guide path 16. FIG. 4 is a plan view illustrating the guide path 16 and stopping positions for the hanger transport devices 18. Note that the reference signs S1, S2, S3, S4, S5 indicate stations (described in detail later) where the hanger transport devices 18 are stopped to execute one of various processes on the workpieces (one process out of a loading process, a projection process, an air-blow process, and an unloading process), and the reference signs Swa, Swb, Swc indicate stations where the hanger transport devices 18 are temporarily stopped on standby.

The guide path 16 is an endless circuitous path formed by a rail 20. The rail 20 is formed into the shape of a rectangle having a length along the apparatus left-right direction in apparatus plan view, and with corner portions of the rectangle bowed so as to be rounded. The guide path 16 is accordingly equipped with four curved paths 16A, 16B, 16C, 16D. Moreover, a transport path 22, for transporting the workpieces W set inside the frame bodies 12 illustrated in FIG. 5 by moving the hanger transport devices 18, is also configured by a circuitous path similar to the guide path 16. A power line main path (bus duct 21) for power supply is also provided along the rail 20.

Figure 13A:
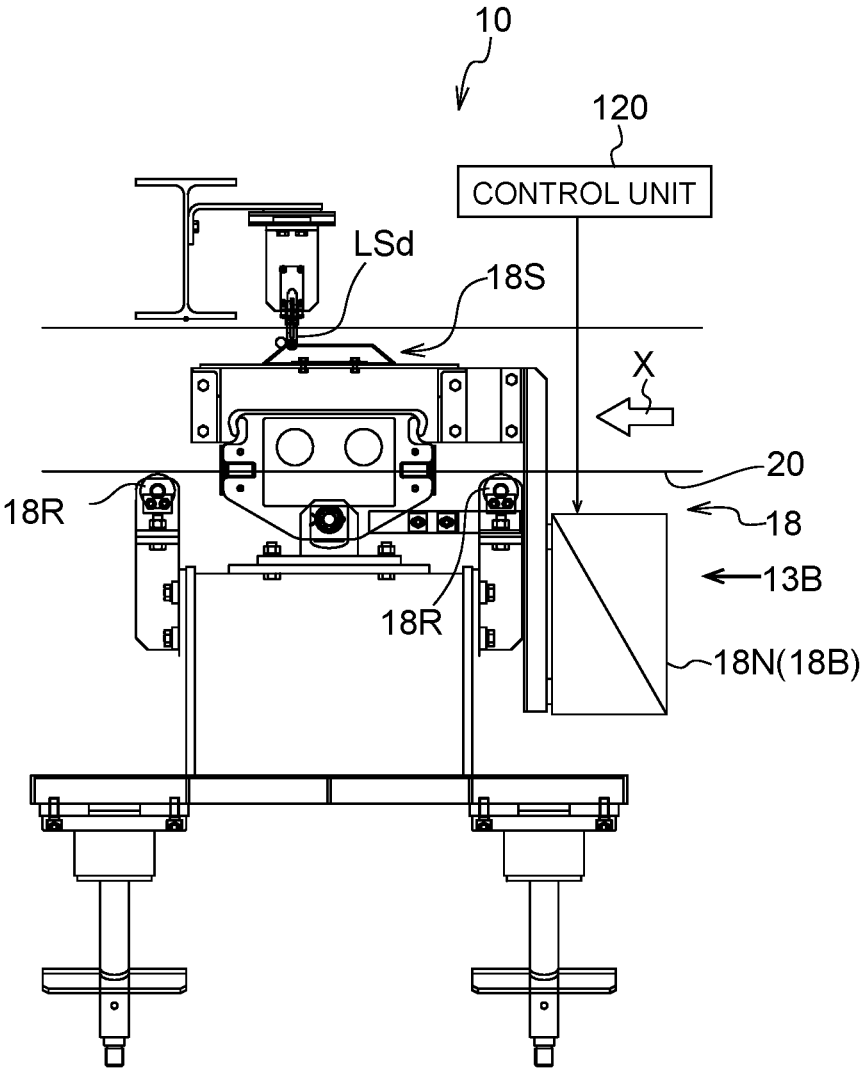
FIG. 13A is diagram illustrating an enlargement of an upper portion of a hanger transport device in the blasting treatment apparatus of FIG. 1.
Figure 13B:
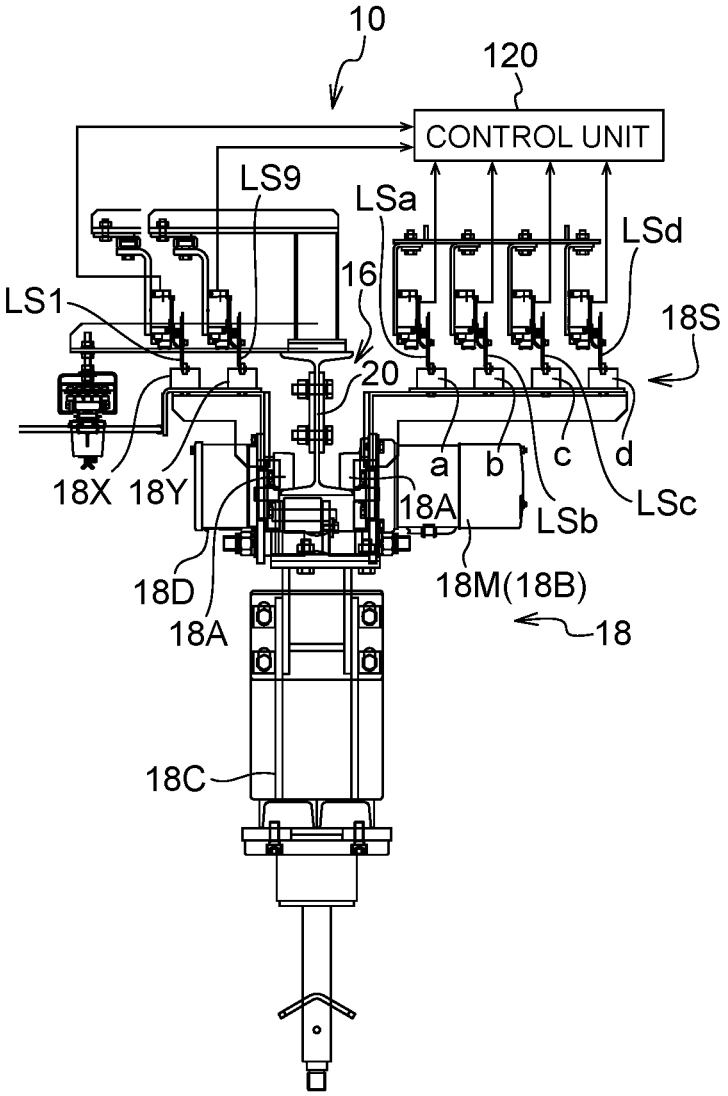
FIG. 13B is a diagram as viewed along an arrow 13B direction of FIG. 13A.

As illustrated in FIG. 13B, the hanger transport devices 18 are each equipped with moving portions 18A that include a crane mechanism and are guided along the guide path 16, and a drive mechanism 18B supplied with power from the bus duct 21 to move the moving portions 18A along the guide path 16. The supply of power from the bus duct 21 to the drive mechanism 18B is performed through connection terminals (not illustrated in the drawings) housed in a terminal box 18D. The drive mechanism 18B and the terminal box 18D are configured so as to move together with the moving portions 18A.

The moving portions 18A are configured including rollers capable of moving while rolling along the length direction of the rail 20. The drive mechanism 18B is configured including a motor 18M to drive the moving portions 18A, and an inverter (not illustrated in the drawings) to adjust the rotation speed of the motor 18M. The inverter is housed inside an inverter board 18N illustrated in FIG. 13A, and is electrically connected to a control unit 120. Note that the hanger transport devices 18 are each equipped with guide rollers 18R serving as members to prevent the moving portions 18A from slipping due to swaying of the work set jigs 14. The guide rollers 18R abut a lower face of the rail 20 and are provided as a pair, one at the transport direction upstream side and one at the transport direction downstream side.

The hanger transport devices 18 are also each equipped with a hanger section 18C integrated to the moving portions 18A. The work set jigs 14 are each hung from the respective hanger section 18C. In the present exemplary embodiment there are plural of the hanger transport devices 18 provided and each of the hanger transport devices 18 is self-propelled. In the present exemplary embodiment there are eight of the hanger transport devices provided. The identification and travel control of the hanger transport devices 18 is described in detail later.

Figure 2:
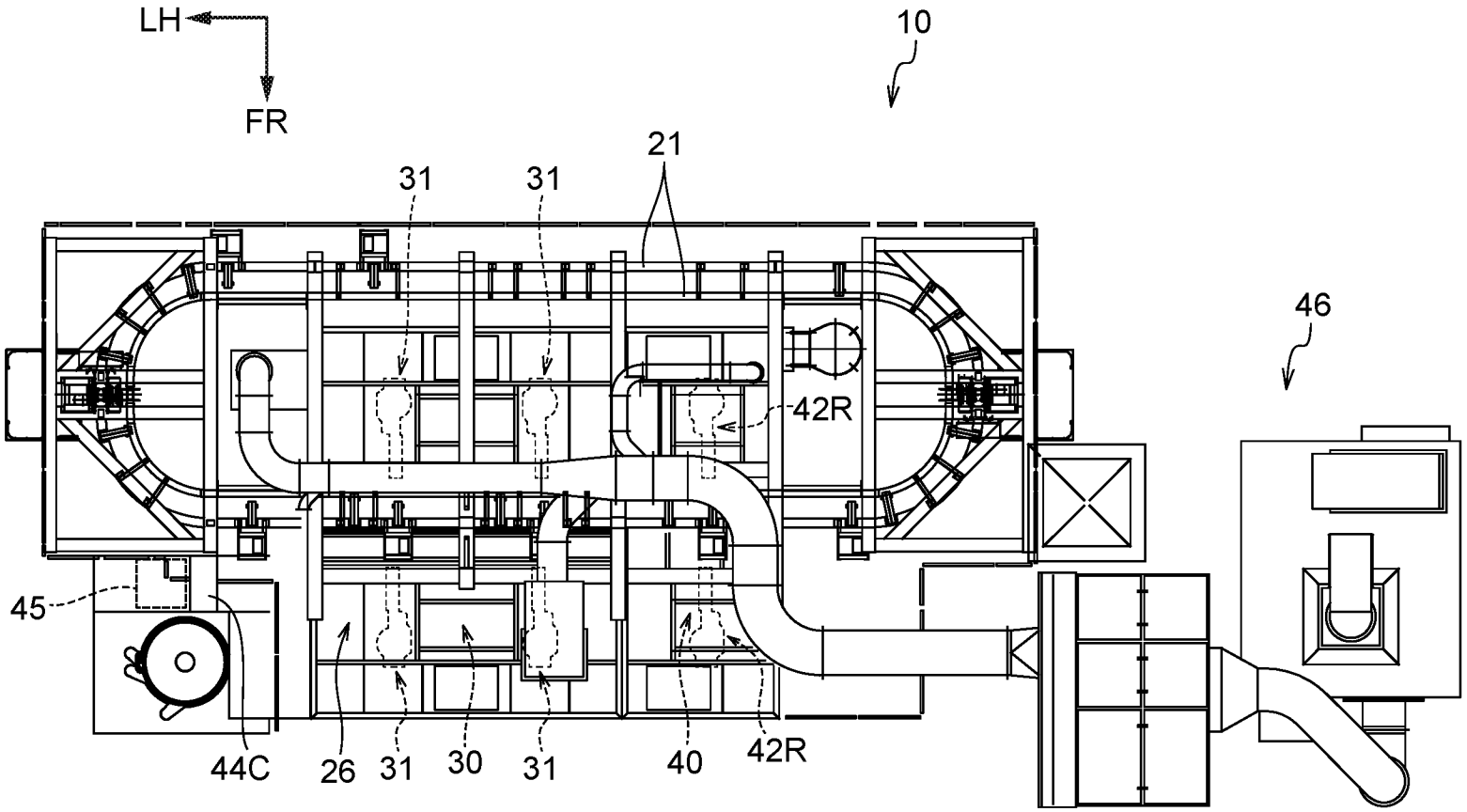
FIG. 2 is a plan view of the blasting treatment apparatus of FIG. 1, as viewed from an apparatus upper side.
Figure 3:
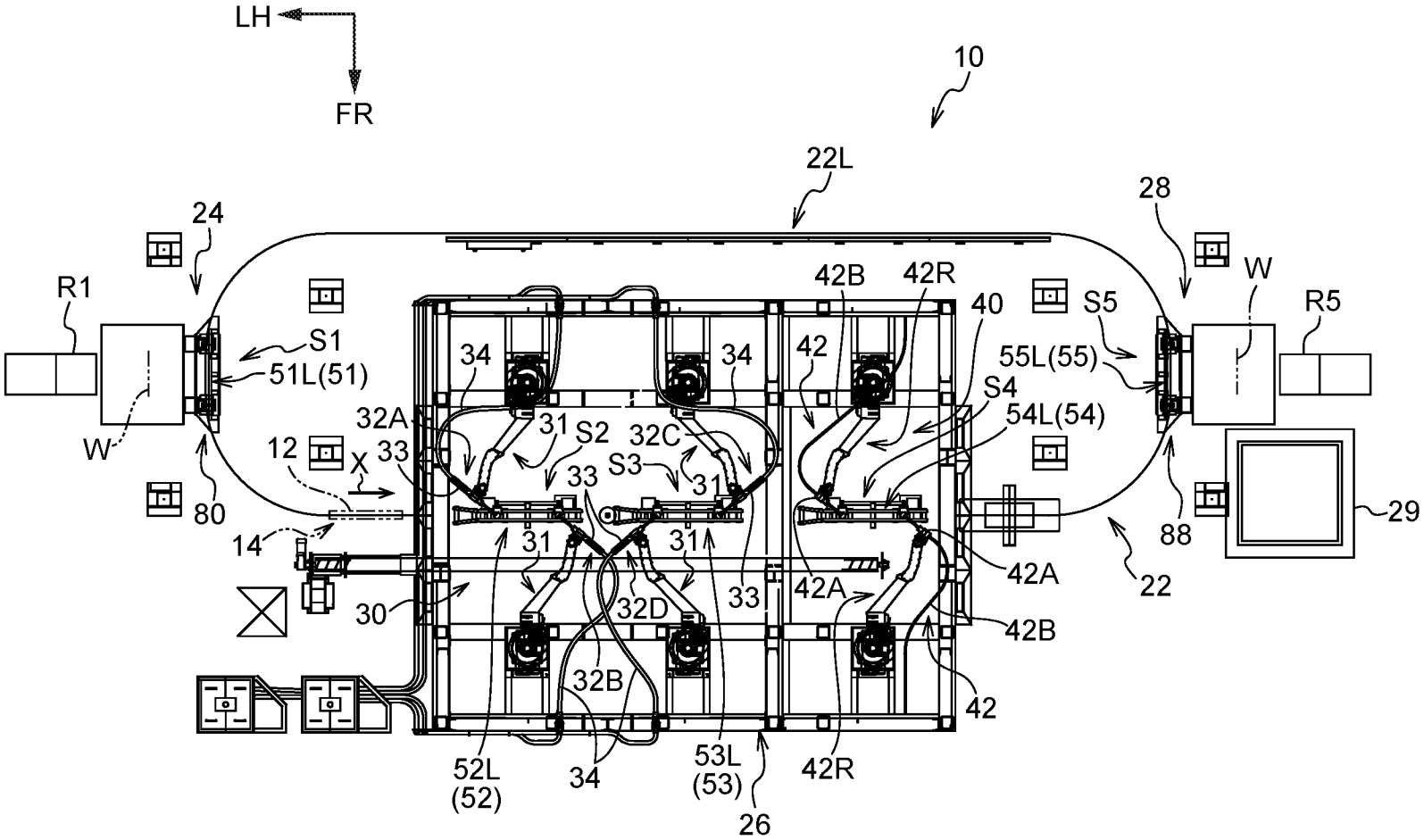
FIG. 3 is a simplified diagram of the blasting treatment apparatus of FIG. 1 sectioned across an apparatus up-down direction intermediate portion, as viewed from the apparatus upper side.

As illustrated in FIG. 1 to FIG. 3, the blasting treatment apparatus 10 is equipped with a cabinet 26 through which the work set jigs 14 pass. As illustrated in FIG. 3, a loading area 24 is provided at the transport direction upstream side of the cabinet 26 (the left side in the drawing), and an unloading area 28 is provided at the transport direction downstream side of the cabinet 26 (the right side in the drawing).

A loading station S1 (transfer station) is provided in the loading area 24 where the workpieces W are each loaded into a work set jig 14 that has been stopped on the transport path 22. An unloading station S5 (transfer station) is also provided in the unloading area 28 where the workpieces W (see FIG. 5) are unloaded from a work set jig 14 that has been stopped on the transport path 22. The loading station S1 and the unloading station S5 are arranged in regions extending along a width direction of the transport path 22 in apparatus plan view. Note that in the transport path 22 of the present exemplary embodiment there is a straight line portion 22L having a straight line shape in apparatus plan view provided in a region the work set jigs 14 are transported when in an empty state, i.e. without a workpiece W set inside the work set jigs 14.

Separately from the hanger transport devices 18, there is also a transfer robot R1 provided in the loading area 24 as a device to load the workpieces W at the loading station S1. The transfer robot R1 performs tasks in a loading process for blasting treatment. Separately from the hanger transport devices 18, there is also a transfer robot R5 provided in the unloading area 28 as a device to unload the workpieces W at the unloading station S5. The transfer robot R5 performs tasks in an unloading process for blasting treatment. In the unloading area 28 there is also a projection media recovery device 29 provided in the vicinity of the transfer robot R5. The projection media recovery device 29 includes a hopper, and is connected to the cabinet 26 so as to be in communication therewith via a non-illustrated pipe. After gripping one of the workpieces W, the transfer robot R5 performs actions to invert the workpiece W above the projection media recovery device 29, and to shake the workpiece W so that projection media that has entered into voids in the workpiece W falls off into the projection media recovery device 29. Note that fine adjustment control of the transfer robots R1, R5 is described in detail later.

Moreover, as illustrated in FIG. 5, a sliding door 25A is provided at the loading side of the cabinet 26, and a sliding door 25C is provided at the unloading side of the cabinet 26. Moreover, a sliding door 25B is also provided inside the cabinet 26 so as to partition the cabinet 26 into a blasting treatment chamber 30 (projection chamber) and an air-blow chamber 40. The sliding doors 25A, 25B, 25C are each, for example, double-sliding doors. The sliding doors 25A, 25B, 25C are provided so as to prevent projection media from flying out from the cabinet 26, and so as to also reduce noise. Note that for simplicity the sliding doors 25A, 25B, 25C are omitted from illustration in FIG. 3.

As illustrated in FIG. 3, a first upstream-side projection machine 32A, a second upstream-side projection machine 32B, a first downstream-side projection machine 32C, and a second downstream-side projection machine 32D are provided on a lateral side of the transport path 22, as projection machines to project projection media onto the workpieces W set inside the frame bodies 12 in the blasting treatment chamber 30. When no distinction is made in the explanation between the first upstream-side projection machine 32A, the second upstream-side projection machine 32B, the first downstream-side projection machine 32C, and the second downstream-side projection machine 32D in the following description they will be abbreviated to projection machines 32A to 32D.

Figure 6:
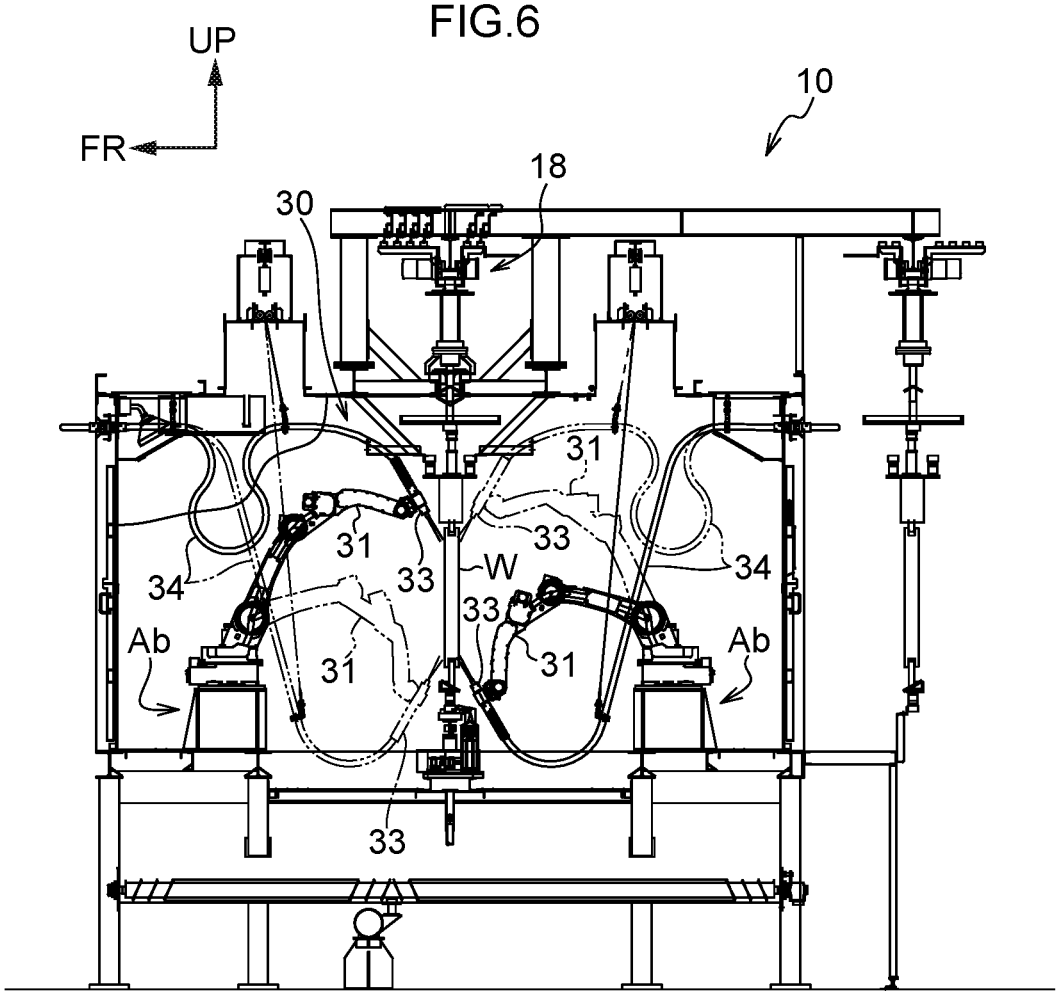
FIG. 6 is a diagram illustrating the blasting treatment apparatus of FIG. 1 sectioned in an apparatus front-rear direction through a shot processing position, as viewed from the right side of the apparatus.

The projection machines 32A to 32D each mix projection media with air compressed by a compressor serving as an air supply system, and are configured as air pressure projection machines that eject the mixture from nozzles 33. A more detailed description thereof is given below. The projection machines 32A to 32D are each equipped with a nozzle 33, with each of the nozzles 33 attached to a leading end portion of a hose 34. As illustrated in FIG. 6, the nozzles 33 are each held by a nozzle holding robot 31. The nozzle holding robots 31 are configured as robot arms that are also capable of gripping, and the nozzles 33 are held by leading end portions of arm members. The nozzle holding robots is disposed on bases Ab 31 and include plural arm members coupled thereto so as to be capable of swinging. The nozzle holding robots 31 moves the leading ends of the nozzles 33 toward the workpieces according to preset data (data corresponding to sites needing projection). Namely, the nozzle holding robots 31 are provided separately from the hanger transport devices 18, and are employed to perform tasks in a projection process for blasting treatment. Note that fine adjustment control of the nozzle holding robots 31 is described in detail later.

The base end sides of the hoses 34 are each connected to a bottom side of a pressure tank 36 through connection sections 35 as illustrated in FIG. 1. Branch sections 35A and mixing valves 35B are provided at the connection sections 35. The connection sections 35 are branching boxes employed for coupling one pressure tank 36 to two mixing valves 35B. The mixing valves 35B are connected to a non-illustrated compressor through tubing. The upper end side of each of the pressure tanks 36 is connected to a shot tank 38 through a valve section 37. The projection media is stored inside the shot tank 38.

In the blasting treatment apparatus 10, in order to project (eject) the projection media using the projection machines 32A to 32D, in a state in which the inside of the pressure tank 36 has been pressurized after feeding sufficient projection media into the pressure tank 36 from the shot tank 38 side, compressed air is flown out from the compressor toward the mixing valve 35B side and the mixing valve 35B is opened. When this is performed, the projection media that has passed from the pressure tank 36 side through the branch section 35A is accelerated by the compressed air flowing toward the mixing valve 35B, passes through the hose 34, and the projection media is then projected out from the nozzle 33. Blasting treatment is accordingly performed on the workpiece W. Namely, the blasting treatment apparatus 10 of the present exemplary embodiment is what is referred to as air blasting equipment.

Projection stations are provided in the blasting treatment chamber 30 illustrated in FIG. 3, as regions where the work set jigs 14 are stopped, and where the projection machines 32A to 32D project the projection media onto the workpieces W. In the present exemplary embodiment there are two projection stations provided (a first projection station S2, and a second projection station S3 arranged at a transport direction downstream side of the first projection station S2). The first projection station S2 and the second projection station S3 are arranged in regions extending along the length direction of the transport path 22 in apparatus plan view. The arrangement and projection range of each of the projection machines 32A to 32D are described in detail later.

The blasting treatment apparatus 10 includes a circulation device 44 (see FIG. 1) to recover projection media projected from the nozzles of the projection machines 32A to 32D, so as to recirculate and reuse the projection media. Although a detailed description of the circulation device 44 will be omitted, hoppers 44A are provided below the blasting treatment chamber 30 and the air-blow chamber 40. There is also a screw conveyor 44B arranged so as to extend along the apparatus left-right direction below the hoppers 44A, and a bucket elevator 44C is arranged at an apparatus upper side at a lateral side of a position at a transport direction downstream side of the screw conveyor 44B. A projection media feed box 45 is provided adjacent to a lower portion of the bucket elevator 44C.

A separator 44D is connected to an upper portion of the bucket elevator 44C. The separator 44D is connected to a dust collector 46 through a duct P1, a duct D1, etc., and is connected to an oscillating sieve 44E through a pipe P2. The dust collector 46 sucks in air including dust (fine powder and the like generated by the blasting treatment). The separator 44D classifies the projection media etc., and exclusively feeds only projection media classified as being appropriate to the oscillating sieve 44E. The oscillating sieve 44E is connected to the shot tank 38 through a pipe P3, and separates projection media into projection media of a reusable size and projection media of a non-reusable size, then exclusively feeds only the material of a reusable size into the shot tank 38.

As illustrated in FIG. 3, a blower 42 is provided at the air-blow chamber 40 on each side of the transport path 22. The pair of blowers 42 are installed so as to blow gas onto a lower portion of the hanger transport devices 18, onto the work set jigs 14, and onto the workpieces W, which are conveyed in the air-blow chamber 40 as illustrated in FIG. 5. An air-blow station S4 is provided inside the air-blow chamber 40, and the work set jigs 14 are each stopped at the air-blow station S4 and the blowers 42 illustrated in FIG. 3 blow gas onto the workpiece W. The air-blow station S4 is arranged in a region extending along the length direction of the transport path 22 in apparatus plan view.

The pair of blowers 42 are each equipped with a nozzle 42A, and the nozzle 42A is attached to a leading end portion of a hose 42B. In the present exemplary embodiment the nozzles 42A are each held by a blower robot 42R. The blower robots 42R serve as robot arms, and each of the nozzles 42A is held by a leading end portion of an arm member. The blower robots 42R are configured so as to move the leading ends of the nozzles 42A toward the workpieces W etc. according to preset data. Namely, the blower robots 42R are provided separately from the hanger transport devices 18, and are employed to perform tasks in an air-blow process of blasting treatment. Note that fine adjustment control of the blower robots 42R is described in detail later. The base end sides of the hoses 42B are connected to a non-illustrated compressed air supply system. Then air (gas) is blown out from the nozzles 42A when compressed air is supplied into the hoses 42B from the compressed air supply system.

Note that a configuration is adopted such that after completion of the processing at each of the stations, i.e. the processing of the loading station S1, the first projection station S2, the second projection station S3, the air-blow station S4, and the unloading station S5, the plural hanger transport devices 18 then move toward the next station. A reduction in the time cycle is thereby achieved.

Configuration of Work Set Jig 14 and Vicinity Thereof

The configuration of the work set jig 14 and the vicinity thereof will now be described.

Respective upper and lower first guide rail sections 51 (stopping area guide sections), second guide rail sections 52 and third guide rail sections 53 (guide sections in the blasting treatment chamber 30), fourth guide rail sections 54 (guide sections in the air-blow chamber 40), and fifth guide rail sections 55 (stopping area guide sections) are provided as rail-shaped guide sections in the blasting treatment apparatus 10 to guide the work set jigs 14 in a hanging state from the hanger transport devices 18 (see FIG. 5). Note that in the following description the suffix L is appended to the reference numerals 51, 52, 53, 54, 55 to indicate a lower guide rail section of these guide rail sections, and the suffix U is appended to the reference numerals 51, 52, 53, 54, 55 to indicate an upper guide rail section of these guide rail sections.

The first guide rail sections 51, the second guide rail sections 52, the third guide rail sections 53, the fourth guide rail sections 54, and the fifth guide rail sections 55 (hereafter abbreviated to the "first to fifth guide rail sections 51 to 55") serve as left and right pairs of guide sections, which are separated from the guide path 16. The first to fifth guide rail sections 51 to 55 are arranged along part of the transport path 22 in a configuration that suppresses swaying of the work set jigs 14 (and therefore swaying of the workpieces W).

As illustrated in FIG. 3 and FIG. 4, the first guide rail sections 51 are formed with an entrance section corresponding to the terminal end side of the curved path 16A in apparatus plan view, and are arranged over a range including a stopping position of the work set jigs 14 at the loading station S1. The second guide rail sections 52 are arranged over a range including a stopping position of the work set jigs 14 at the first projection station S2 in the blasting treatment chamber 30. The third guide rail sections 53 are arranged over a range including a stopping position of the work set jigs 14 at the second projection station S3 in the blasting treatment chamber 30. The fourth guide rail sections 54 are arranged over a range including a stopping position of the work set jigs 14 at the air-blow station S4 in the air-blow chamber 40. The fifth guide rail sections 55 are formed with an entrance section corresponding to the terminal end side of the curved path 16C in apparatus plan view (see FIG. 4), and are arranged over a range including a stopping position of the work set jigs 14 at the unloading station S5. In the present exemplary embodiment, there are regions provided in the blasting treatment apparatus 10 where there are no rail-shaped guide sections (the first to fifth guide rail sections 51 to 55) arranged along the transport path 22 in apparatus plan view.

Figure 7A:
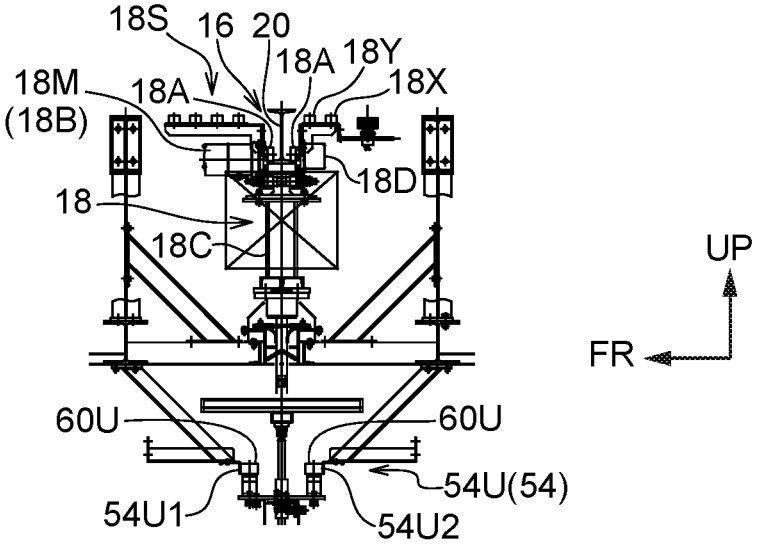
FIG. 7A is a diagram illustrating an upper guide rail section etc. as in a blasting treatment chamber and in an air-blow chamber, as viewed from the apparatus right side (from an arrow 7A direction of FIG. 7B).
Figure 7B:
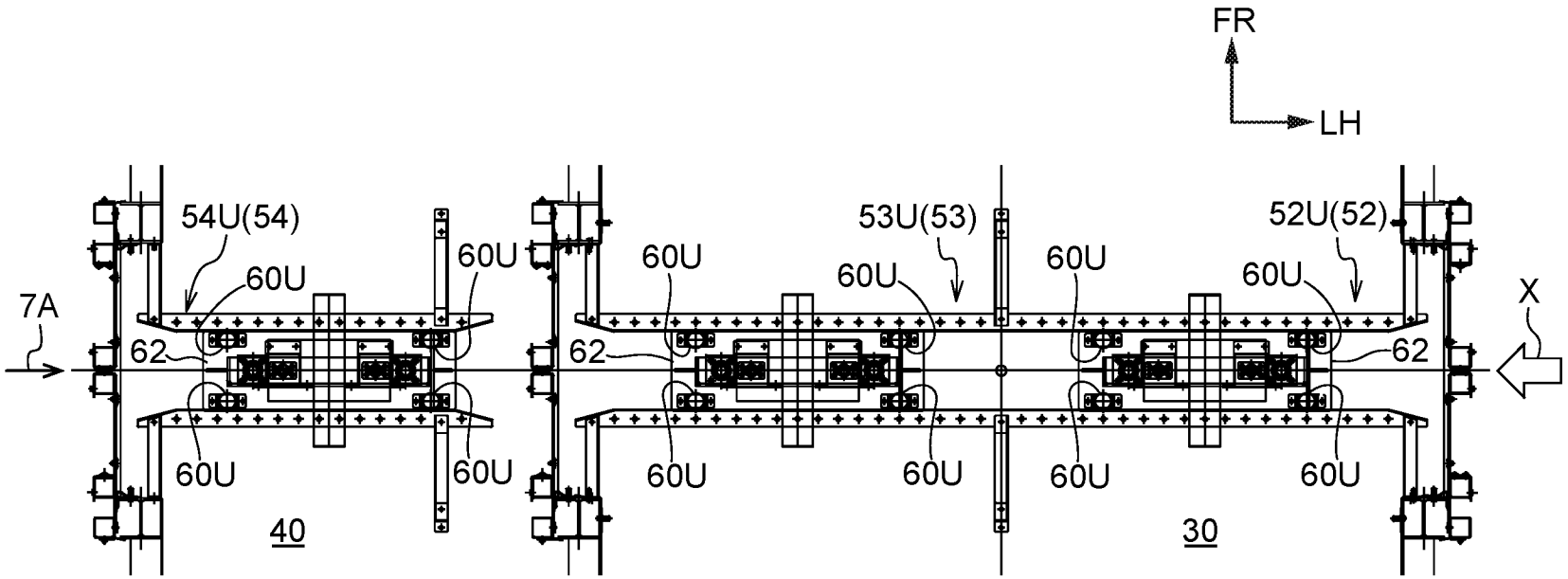
FIG. 7B is a plan view illustrating upper guide rail sections etc., as viewed from the apparatus upper side.

As illustrated in FIG. 7B, the upper guide rail sections 52U, 53U of the second guide rail sections 52 and the third guide rail sections 53 are formed connected together. The upper guide rail sections 52U, 53U, 54U are formed by L-shaped metal plates arranged in pairs so that one leg of the metal plates in each pair configure opposing pendent portions, (see metal plates 54U1, 54U2 in FIG. 7A).

Figure 8:
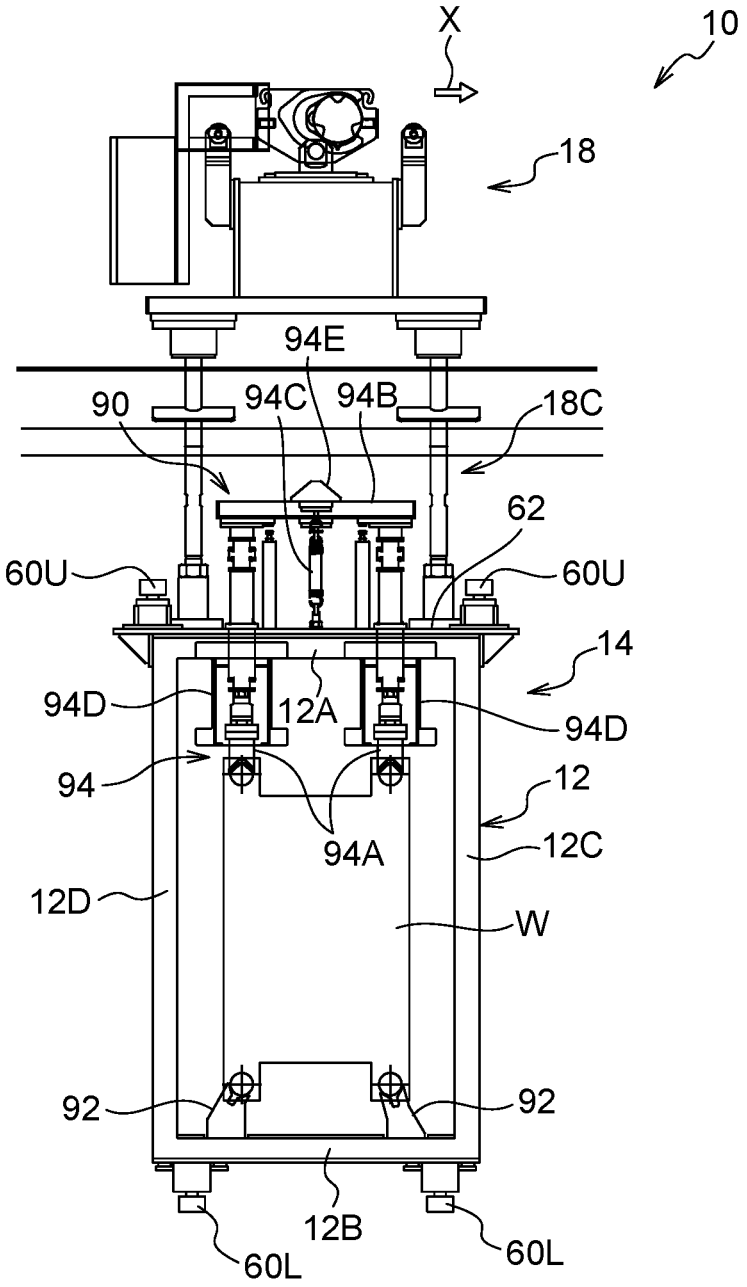
FIG. 8 is a diagram illustrating a work set jig in a hanging state hanging from a hanger transport device in the blasting treatment apparatus of FIG. 1, as viewed from a lateral side of a transport path.

As illustrated in FIG. 8, the frame bodies 12 of the work set jigs 14 are each formed in a rectangular shape in front face view of the work set jig 14. Namely, the frame bodies 12 each include an upper and lower pair of cross members 12A, 12B arranged facing each other, and a pair of vertical members 12C, 12D connecting together the length direction end portions of the upper and lower pair of cross members 12A, 12B. In each of the frame bodies 12, the workpiece W is set between the upper and lower pair of cross members 12A, 12B, and between the pair of vertical members 12C, 12D (in other words inside the frame body 12).

Rollers 60L are provided as guided sections in each of the work set jigs 14, below the frame bodies 12 and at each of the left and right sides in front face view of the work set jig 14. The rollers 60L are rotatable about axes running in a vertical direction of the apparatus and are guided by the lower guide rail sections 51L, 52L, 53L, 54L, 55L of the first to fifth guide rail sections 51 to 55 illustrated in FIG. 3 (hereafter abbreviated to "lower guide rail sections 51L to 55L"). The lower guide rail sections 52L, 53L, 54L are arranged so that transport direction upstream side portions thereof are inclined whereby openings at the transport direction upstream side portions are widen toward the transport direction upstream side. This facilitates entry of the rollers 60L in the lower guide rail sections 52L, 53L, 54L.

A top plate 62 is fixed at the top face side of the frame body 12 in the work set jig 14. As illustrated in FIG. 7A to FIG. 8, rollers 60U are also provided as guided sections above each of the four corners of the top plate 62. The rollers 60U are rotatable about axes running in the apparatus vertical direction. The rollers 60U are guided by the upper guide rail sections 51U, 52U, 53U, 54U, 55U of the first to fifth guide rail sections 51 to 55 (hereafter abbreviated to "upper guide rail sections 51U to 55U) (see FIG. 5). Note that as illustrated in FIG. 8, the top plate 62 of the work set jig 14 is hung from the hanger section 18C of the hanger transport device 18.

The blasting treatment apparatus 10 includes a projection positioning unit 70 configured to position the work set jig 14 at a stopping position in the blasting treatment chamber 30 when in a state in which the hanger transport device 18 is stopped so that the work set jig 14 is disposed at the stopping position, Note that as a modified example, a configuration may be adopted in which the projection positioning unit 70 positions the work set jig 14 at the stopping position in the blasting treatment chamber 30 when the work set jig 14 is in a slowly transported state by the hanger transport device 18 in the blasting treatment chamber 30, and in which the hanger transport device 18 is stopped in response to the positioning of the work set jig 14.

Figure 9A:
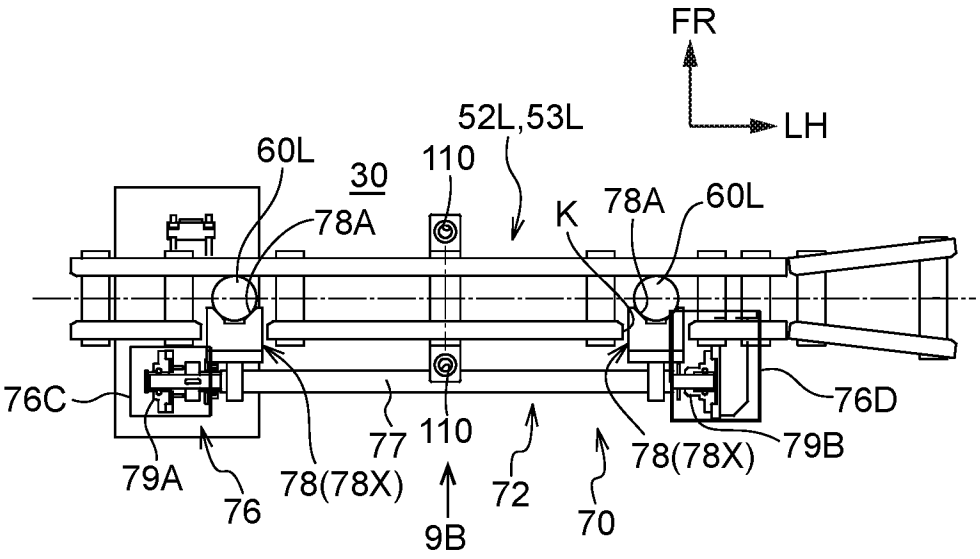
FIG. 9A is a plan view of a projection positioning mechanism in a blasting treatment chamber of the blasting treatment apparatus of FIG. 1, as viewed from the apparatus upper side.
Figure 9B:
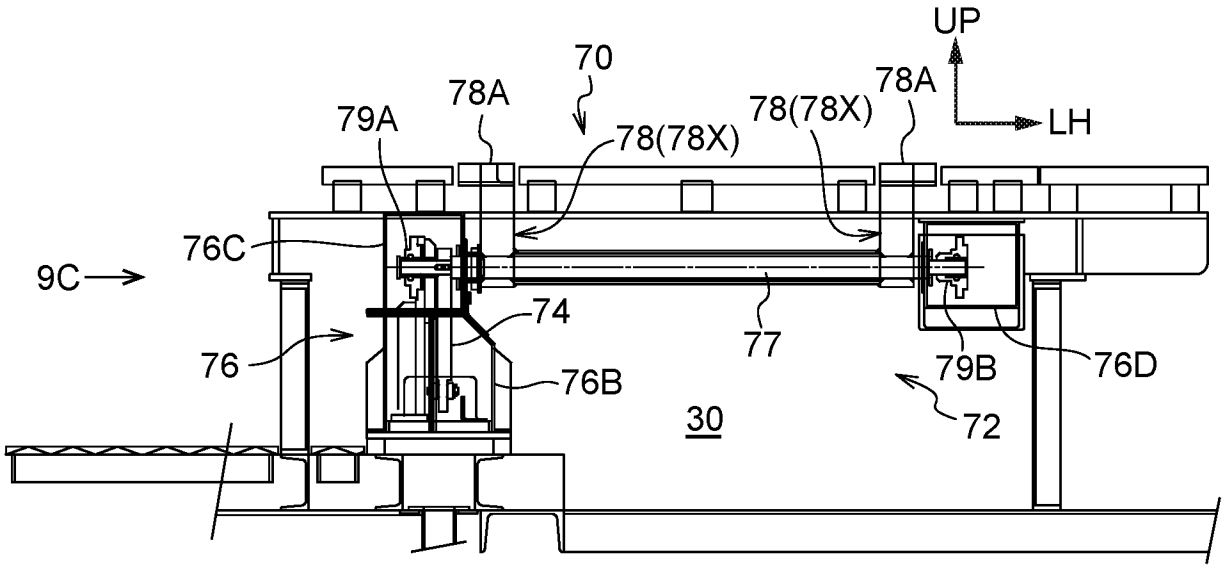
FIG. 9B is a diagram as viewed along an arrow 9B direction of FIG. 9A.
Figure 9C:
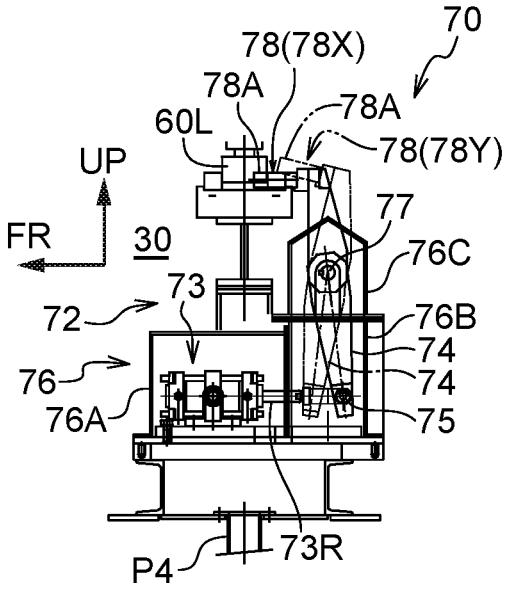
FIG. 9C is a diagram as viewed along an arrow 9C direction of FIG. 9B.

As illustrated in FIG. 9A to FIG. 9C, the projection positioning unit 70 is equipped with a pressing section 72 to press and position the rollers 60L so as to stop the work set jig 14 at the stopping position in the blasting treatment chamber 30. In other words, the projection positioning unit 70 is configured so as to position the work set jig 14 using the rollers 60L and the pressing section 72. Moreover, the first projection station S2 and the second projection station S3 illustrated in FIG. 4 are stations where the hanger transport device 18 stops and where the work set jig 14 is positioned by the projection positioning unit 70.

The pressing section 72 is equipped with a drive cylinder 73 arranged in the blasting treatment chamber 30, and with a bar-shaped member 74 having one end side coupled to a leading end side of a piston rod 73R of the drive cylinder 73. The drive cylinder 73 is, for example, an air cylinder arranged with an axial direction along the apparatus front-rear direction, and non-illustrated wiring and tubing extends into a pipe P4 below. The bar-shaped member 74 is capable of swinging about an axis running along a direction orthogonal to an extension direction of the piston rod 73R. The drive cylinder 73 and the bar-shaped member 74 are covered by a cover structure 76. The cover structure 76 is configured by a cover 76A covering part of the drive cylinder 73, a cover 76B covering part of the drive cylinder 73 and part of the bar-shaped member 74, and a cover 76C covering part of the bar-shaped member 74. Note that in order to facilitate understanding of the configuration, the walls of the covers 76A, 76B, 76C are illustrated in a see-through state in FIG. 9A to FIG. 9C.

The pressing section 72 is equipped with a shaft member 77 that extends along a direction parallel to the axial direction of a swing shaft 75 at one end side (a lower end side) of the bar-shaped member 74 and that is supported so as to be rotatable about its own axis. The shaft member 77 extends along the apparatus left-right direction with the other end side (upper end side) of the bar-shaped member 74 fixed to the shaft member 77 such that the shaft member 77 is rotated about its own axis by swinging of the bar-shaped member 74 interlocked with a reciprocating movement of the piston rod 73R.

An end portion at one axial direction side of the shaft member 77 (the left side in the drawings of FIG. 9A and FIG. 9B) and a shaft bearing structure section 79A for bearing this end portion are covered by the cover 76C described above, and an end portion at the other axial direction side of the shaft member 77 (the right side in the drawings of FIG. 9A and FIG. 9B) and a shaft bearing structure section 79B for bearing this end portion are covered by the cover 76D. In order to facilitate understanding of the configuration, the walls of the cover 76D are illustrated in a see-through state in the drawings.

Moreover, the base end sides of pressing members 78 are fixed to portions at the both sides in the length direction of the shaft member 77 not covered by the covers 76C, 76D. The left and right pair of pressing members 78 can each be swung by rotation of the shaft member 77 between a pressing position 78X at which a pressing portion 78A at the leading end side of the pressing member 78 presses the roller 60L, and a release position 78Y at which the leading end side of the pressing portion 78A is separated from the rollers 60L (see FIG. 9C). The pressing portions 78A are each formed with an indented shape that a portion of the roller 60L fits into when the pressing portion 78A is in a state disposed in the pressing position 78X (see FIG. 9A). Note that a portion at the leading end side of each of the pressing members 78 is disposed so as to enter through a cutaway K formed in the lower guide rail sections 52L, 53L.

Moreover, as illustrated in FIG. 5, the blasting treatment apparatus 10 includes an air-blow positioning unit 170 configured to position the work set jig 14 at a stopping position of the air-blow station S4, in a state in which the hanger transport device 18 is stopped so that the work set jig 14 is disposed at the stopping position. Note that as a modified example, a configuration may be adopted in which the air-blow positioning unit 170 positions the work set jig 14 at the stopping position of the air-blow station S4 when the work set jig 14 is in a slowly transported state by the hanger transport device 18, and in which the hanger transport device 18 is stopped in response to the positioning of the work set jig 14. The air-blow positioning unit 170 of the present exemplary embodiment is similar to the projection positioning unit 70 for positioning at the stopping positions in the blasting treatment chamber 30, and so detailed drawings and detailed explanation thereof will be omitted. Note that the air-blow station S4 is a station where the hanger transport device 18 is stopped and where the work set jig 14 is positioned by the air-blow positioning unit 170.

The blasting treatment apparatus 10 also includes a transfer positioning unit 80 configured to, in a state in which the hanger transport device 18 is stopped so that the work set jig 14 is disposed at the stopping position of loading station S1, position the work set jig 14 at the stopping position of the loading station S1. Note that as a modified example, a configuration may be adopted in which the transfer positioning unit 80 positions the work set jig 14 at the stopping position of the loading station S1 when the work set jig 14 is in a slowly transported state by the hanger transport device 18, and in which the hanger transport device 18 is stopped in response to the positioning of the work set jig 14.

Figure 10A:
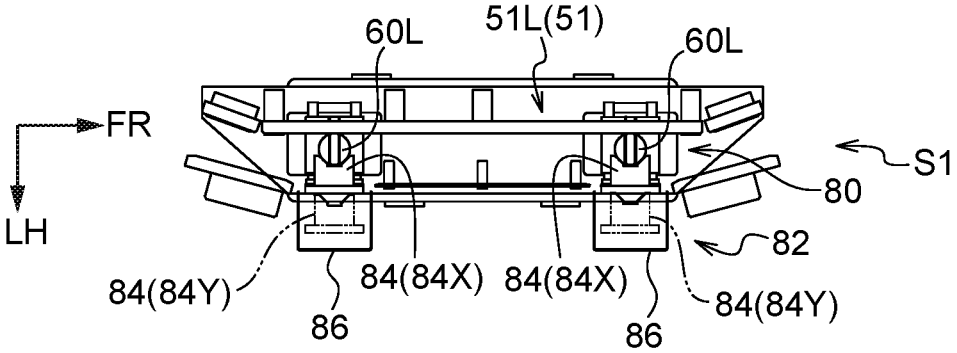
FIG. 10A is a plan view illustrating a transfer positioning mechanism at a loading station of the blasting treatment apparatus of FIG. 1, as viewed from the apparatus upper side.
Figure 10B:
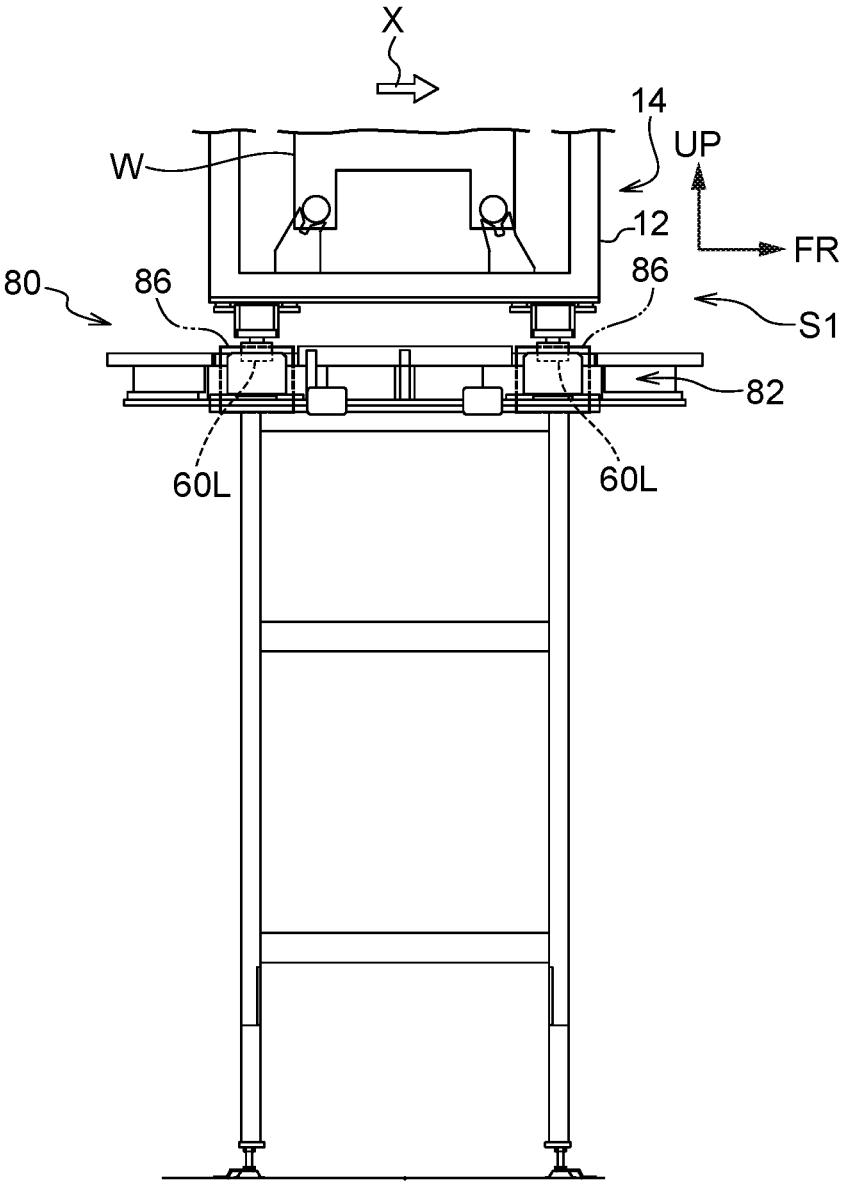
FIG. 10B illustrates the transfer positioning mechanism of FIG. 10A, as viewed from the apparatus left side.

As illustrated in FIG. 10A and FIG. 10B, the transfer positioning unit 80 is equipped with a pressing section 82 to press and position the rollers 60L so as to stop the work set jig 14 at the stopping position at the loading station S1. In other words, the transfer positioning unit 80 is configured so as to position the work set jig 14 using the rollers 60L and the pressing section 82. Moreover, the loading station S1 is a station where the hanger transport device 18 is stopped and where the work set jig 14 is positioned by the transfer positioning unit 80.

The pressing section 82 is equipped with a pressing member 84. The pressing member 84 is capable of being moved between a pressing position 84X pressing the rollers 60L and a release position 84Y separated from the rollers 60L, so as to be moved by a non-illustrated drive section. The pressing member 84 is covered by a cover 86 when in a state disposed in the release position 84Y. Note that in order to facilitate understanding of the release position 84Y, the cover 86 is illustrated in FIG. 10A as being in a see-through state, and the release position 84Y is illustrated by double-dot broken lines. Moreover, in FIG. 10B the pressing member 84 is illustrated with the cover 86 in a see-through state, with the outline of the cover 86 illustrated by double-dot broken lines.

The blasting treatment apparatus 10 also includes a transfer positioning unit 88 configured to position the work set jig 14 at the stopping position of the unloading station S5 in a state in which the hanger transport device 18 is stopped so that the work set jig 14 is disposed at the stopping position. Note that as a modified example, a configuration may be adopted in which the transfer positioning unit 88 positions the work set jig 14 at the stopping position of the unloading station S5 when the work set jig 14 is in a slowly transported state by the hanger transport device 18, and in which the hanger transport device 18 is stopped in response to the positioning of the work set jig 14. The transfer positioning unit 88 of the present exemplary embodiment is similar to the transfer positioning unit 80 of the loading station S1 as described above, and so detailed drawings and detailed explanation thereof will be omitted. Note that the unloading station S5 is a station where the hanger transport device 18 is stopped and where the work set jig 14 is positioned by the transfer positioning unit 88.

In the following description, collective reference to the loading station S1, the first projection station S2, the second projection station S3, the air-blow station S4, and the unloading station S5, where the hanger transport device 18 is stopped and where the work set jig 14 is positioned by a positioning unit (the transfer positioning units 80, 88, the projection positioning unit 70, or the air-blow positioning unit 170), will be abbreviated in the description to the stations S1 to S5.

Workpiece W Fixing Mechanism

Explanation follows regarding a mechanism to fix the workpiece W.

The blasting treatment apparatus 10 includes a fixing clamp unit 90 to fix the workpiece W illustrated in FIG. 8 by clamping inside the frame bodies 12 (i.e. between the upper and lower pair of cross members 12A, 12B). The clamp unit 90 is disposed so as to fix each of the workpieces W inside the frame body in a state in which the work set jig 14 is positioned at the stopping position in the blasting treatment chamber 30 by the projection positioning unit 70 illustrated in FIG. 9A. The clamp unit 90 is equipped with mounting portions 92 provided at a lower inside portion of the frame body 12 on which to mount the workpiece W, and is equipped with a holding section 94 to hold the workpiece W set inside the frame body 12 from above.

In the present exemplary embodiment, the mounting portions 92 are installed so as to upstand from both the left and right sides of an opening bottom edge of the frame body 12 in a front face view of the work set jig 14, and are formed with upward opening notched portions on the upper end sides thereof. The holding section 94 in contrast is configured to include holding members 94A disposed with axial directions along a vertical direction of the apparatus so as to pass through an upper portion of the frame body 12 and penetrate through the top plate 62, a first horizontal member 94B to which upper ends of the holding members 94A are fixed, and a tension spring 94C serving as an elastic member coupling the first horizontal member 94B and the top plate 62 together.

The holding members 94A hold the workpiece W set inside the frame bodies 12 from above. As an example, the holding members 94A are provided as a pair directly above the mounting portions 92 in front face view of the work set jig 14, and are formed with downward opening V-shaped notch portions on the lower end sides thereof. Note that as an example a tube shaped member (not illustrated in the drawings) of concertina shape capable of extending and contracting is installed at a peripheral outside of the holding members 94A. Moreover, a cylinder 94D is disposed inside the frame body 12 at the peripheral outside of each of the holding members 94A. An upper end portion of each of the cylinders 94D is attached to an upper portion of the frame body 12. Note that in the drawings the cylinder 94D is illustrated in a half cross-section sectioned along the axial direction thereof. Moreover, the first horizontal member 94B to which the upper ends of the holding members 94A are fixed is disposed parallel to and above the top plate 62, and extends along the extension direction of the frame body 12 in apparatus plan view. The tension spring 94C is disposed at a central portion between the pair of holding members 94A in front face view of the work set jig 14, and urges the holding members 94A toward the workpiece W set inside the frame body 12. The upper end portion of the tension spring 94C is attached to a length direction central portion of the first horizontal member 94B.

A second horizontal member 94E is fixed to an upper face side of the length direction central portion of the first horizontal member 94B. The second horizontal member 94E is a substantially triangular tube shaped member that extends in a horizontal direction and a direction orthogonal to the extension direction of the first horizontal member 94B (see FIG. 11A and FIG. 11B). The first horizontal member 94B is fixed to a length direction central portion of the second horizontal member 94E.

Workpiece W Fixing Release Mechanism

Explanation follows regarding a mechanism to release fixing of the workpiece W.

Figure 11A:
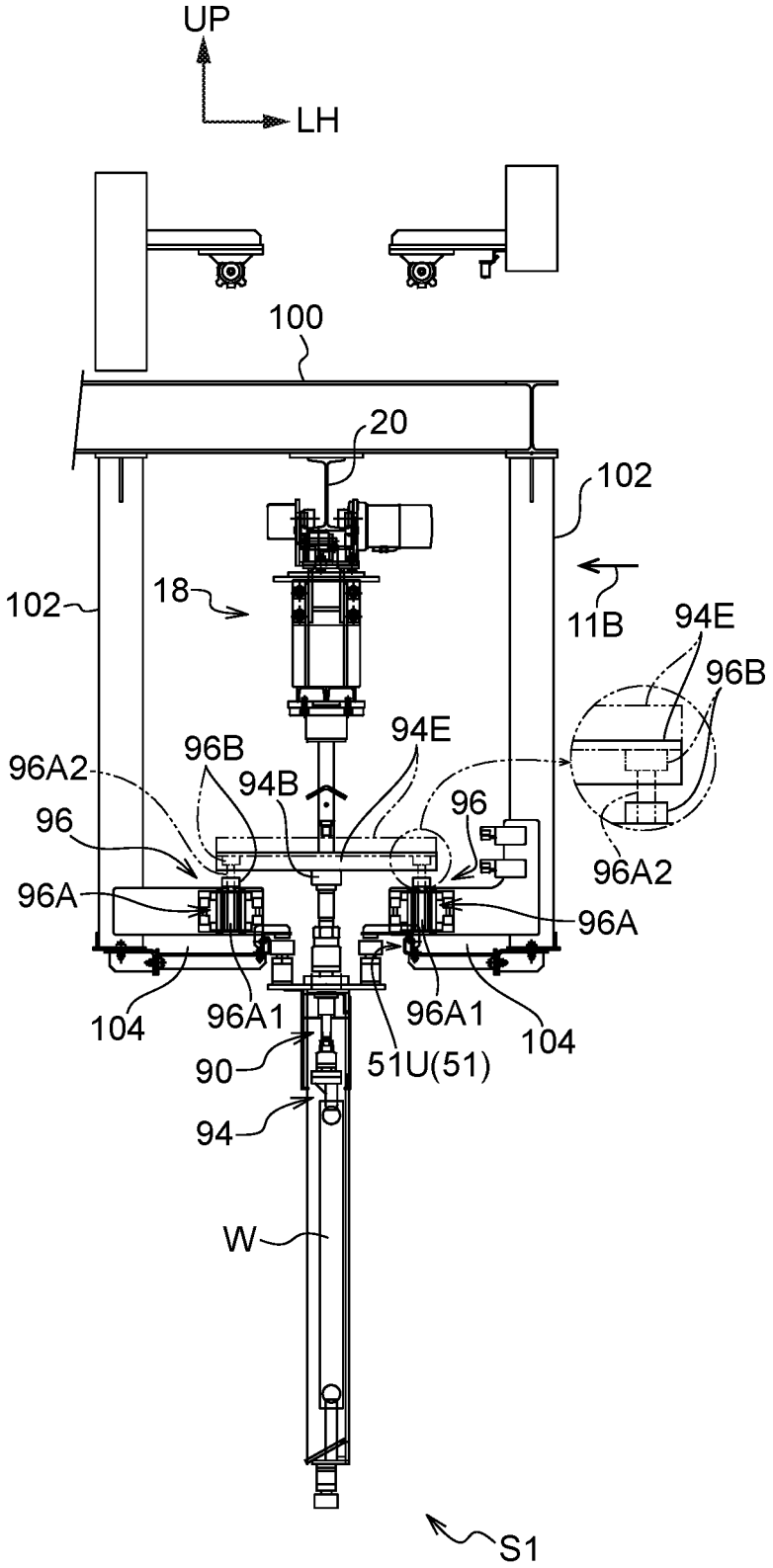
FIG. 11A illustrates portions for workpiece attaching-detaching and the like at a loading station of the blasting treatment apparatus of FIG. 1, as viewed from the apparatus rear side.
Figure 11B:
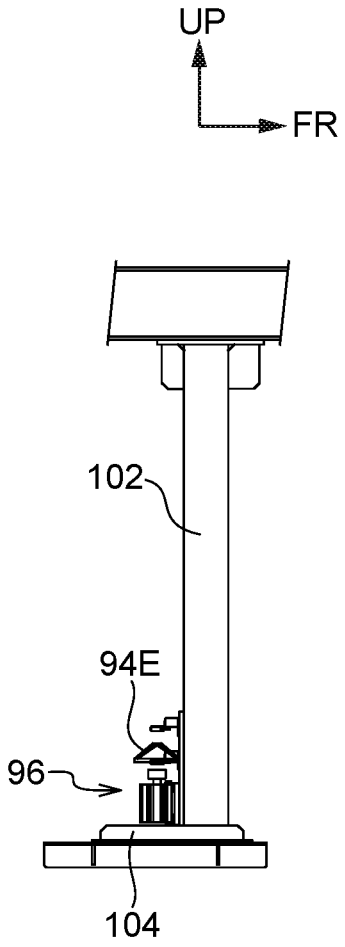
FIG. 11B is a diagram as viewed along an arrow 11B direction of FIG. 11A.

As illustrated in FIG. 11A and FIG. 11B, at the loading station S1, a pair of pendent members 102, which are pendent from a beam member 100 to which the rail 20 is fixed, are arranged so as to be disposed on either side of the path of the hanger transport devices 18. A horizontal member 104 is fixed to each of lower end portions of the pair of pendent members 102, and the pair horizontal members 104 extend in directions approaching each other. The upper guide rail sections 51U of the first guide rail sections 51 are provided at the opposing face sides of the leading end portions of the pair of horizontal members 104.

A displacement unit 96 is provided above each of the pair of horizontal members 104. The displacement unit 96 is equipped with a cylinder 96A disposed with an axial direction along the apparatus vertical direction. The cylinder 96A is equipped with an outer cylinder body 96A1, and a rod 96A2 capable of extending and retracting in an axial direction from an opening at the upper end side of the outer cylinder body 96A1. An abutting member 96B is fixed to the leading end portion (upper end portion) of each of the rods 96A2. The abutting member 96B is configured so as to hold up the first horizontal member 94B (part of the holding section 94 of the clamp unit 90 illustrated in FIG. 8) via the second horizontal member 94E when the rods 96A2 are extended. In other words, the displacement unit 96 provided in the loading station S1 is configured so as to overcome urging force of the tension spring 94C and displace the holding members 94A of the clamp unit 90 illustrated in FIG. 8 in a holding release direction.

A displacement unit 98 for releasing fixing of the workpiece W is provided in the unloading station S5 of the blasting treatment apparatus 10 illustrated in FIG. 5. The displacement unit 98 is configured so as to overcome urging force of the tension spring 94C and displace the holding members 94A of the clamp unit 90 in a holding release direction. The displacement unit 98 is similar to the displacement unit 96 of the loading station S1 as described above, and so detailed drawings and detailed explanation thereof will be omitted.

Hanger Transport Device 18 Identification and Travel Control, and Robot Control Explanation follows regarding identification and travel control of the hanger transport devices 18, and robot control. Note that, for example, robots equipped with known configurations as disclosed in JP-A Nos. 2013-158876 and 2016-083706, may be applied as the transfer robots R1, R5, the nozzle holding robots 31, and the blower robot 42R. The configurations of these robots are known, and so detailed explanation thereof will be omitted. The transfer robots R1, R5, the nozzle holding robots 31, and the blower robot 42R are electrically connected to the control unit 120.

An identification information provider section 18S is provided at one side of an upper end portion of each of the hanger transport devices 18 (more specifically, at a side opposite to an inner side of the circulatory loop in apparatus plan view) to provide identification information of each of the hanger transport devices 18. In the present exemplary embodiment, the identification information provider section 18S is equipped with a projecting portion at one or two locations from out of locations a, b, c, d in the drawings. The number and placement locations of the projecting portions are set so as to be different for each of the hanger transport devices 18. Note that for ease of explanation, four locations of a, b, c, d are illustrated as the projecting portions of the identification information provider section 18S in FIG. 13B (for convenience a similar approach is also adopted in FIG. 5 to FIG. 7 etc.).

The projecting portions formed at the identification information provider section 18S are capable of contacting limit switches LSa, LSb, LSc, LSd (hereafter referred to as simply as "limit switches LSa to LSd"; also serving as elements corresponding to a detection means) employed for transport device identification and provided to an upper portion of the blasting treatment apparatus 10. The control unit 120 is also electrically connected to the limit switches LSa to LSd. The control unit 120 is configured so as to be able to recognize which of the hanger transport devices 18 passes from which of the limit switches LSa to LSd is switched ON by contact with the projecting portions of the identification information provider section 18S.

A first contact portion 18X is also provided as a projecting portion at another side of the upper end portion of the hanger transport device 18 (more specifically, at the inner side of the circulatory loop in apparatus plan view). The first contact portion 18X is capable of contacting limit switches LS1, LS2, LS3 (hereafter referred to as simply as "limit switches LS1 to LS3", see FIG. 4) employed for acceleration and deceleration and provided to the upper portion of the blasting treatment apparatus 10. The control unit 120 is also electrically connected to the limit switches LS1 to LS3. In cases in which the limit switches LS1 to LS3 have been switched ON by contact with the first contact portion 18X, the control unit 120 outputs a control signal to an inverter (not illustrated in the drawings) packaged on the inverter board 18N of the hanger transport device 18 and controls the movement velocity of the hanger transport device 18 so that the hanger transport device 18 is accelerated or decelerated based on preset information.

A second contact portion 18Y is also provided as a projecting portion adjacent to the first contact portion 18X, but separated from the first contact portion 18X. The second contact portion 18Y is capable of contacting limit switches LS9 (elements corresponding to a detection means) employed for stopping and provided at the upper portion of the blasting treatment apparatus 10. The control unit 120 is electrically connected to the limit switches LS9. In cases in which one of the limit switches LS9 has been switched ON by contact with the second contact portion 18Y, the control unit 120 outputs a control signal to an inverter (not illustrated in the drawings) packaged on the inverter board 18N of the drive mechanism 18B of the hanger transport device 18 so as to stop the hanger transport device 18.

As illustrated in FIG. 4, a limit switch LS1 (first detection member) is disposed in the vicinity of a start end side (in the vicinity of transport direction upstream end portions) of the curved paths 16A, 16C in apparatus plan view. Limit switches LS2 (examples of a second detection member of a sixth aspect) are disposed at the transport direction upstream side of the stations S1 to S5 at which the hanger transport devices 18 are stopped and at which the work set jigs 14 are positioned. A limit switch LS3 (an example of a second detection member of a seventh aspect) is disposed at a position corresponding to the transport direction upstream side of the straight line portion 22L. Limit switches LS9 employed for stopping are respectively disposed at positions corresponding to each of the stopping positions of the hanger transport devices 18 illustrated in FIG. 4. Limit switches LSa to LSd employed for transport device identification may each be disposed at the respective positions along the transport direction where the limit switches LS1 to LS3 and the limit switch LS9 are disposed.

A control unit 120 controls a movement velocity of the hanger transport devices 18 in the following manner. At a timing when one of the hanger transport devices 18 has been detected, by the limit switch LS1 (LS1*a*) provided in the vicinity of the start end side of the curved path 16A as passing in the vicinity of a placement position of the limit switch LS1 (LS1*a*), a movement velocity of this hanger transport device 18 is set to a movement velocity V1*a* (a first movement velocity) that enables the rollers 60U to enter between the left and right pair of first guide rail sections 51 even if the work set jig 14 sways under centrifugal force. The movement velocity V1*a* is, for example, 12.5 m/min. Similarly, at a timing when one of the hanger transport devices 18 has been detected, by the limit switch LS1 (LS1*b*) provided in the vicinity of the start end side of the curved path 16C in apparatus plan view, as passing in the vicinity of a placement position of the limit switch LS1 (LS1*b*), a movement velocity of this hanger transport device 18 is set to a movement velocity V1*b* (a first movement velocity) that enables the rollers 60U to enter between the left and right pair of fifth guide rail sections 55 even if the work set jig 14 sways under centrifugal force. The movement velocity V1*b* is, for example, 12.5 m/min.

Moreover, at a timing when one of the hanger transport devices 18 is detected by the limit switch LS2 as passing in the vicinity of a placement position of the limit switch LS2, a movement velocity of this hanger transport device 18 is controlled to be set at a movement velocity V2. The movement velocity V2 is set to a velocity (6 m/min, for example) lower than the movement velocities V1*a*, V1*b* set at the timing when the hanger transport device 18 was detected by the limit switch LS1 as passing in the vicinity of the placement position of the limit switch LS1. Furthermore, a movement velocity of this hanger transport device 18 is controlled and is set at a movement velocity V3 at a timing when the hanger transport device 18 has been detected by the acceleration limit switch LS3 as passing in the vicinity of the placement position of the limit switch LS3. The movement velocity V3 (an example of the second velocity in the seventh aspect) is set to a velocity (25 m/min, for example) higher than the movement velocities V1*a*, V1*b* set at the timing when the hanger transport device 18 was detected by the limit switch LS1 as passing in the vicinity of the placement position of the limit switch LS1.

The control unit 120 illustrated in FIG. 13A and FIG. 13B is configured to include, for example, a storage device, a computation processing device, and the like. Although details are omitted from illustration, such a computation processing device is equipped with a CPU, RAM, ROM, and communication interface (I/F), with these all connected together through a bus. A program for various control processing is stored in the ROM. The storage device and the computation processing device are capable of communicating with each other through a mutual communication interface (I/F). A configuration is adopted in the control unit 120 such that the control processing program is read from the ROM in response to operation by a worker on a non-illustrated operation panel, the control processing program is expanded into the RAM, and the control processing program expanded in the RAM is executed by the CPU.

The control unit 120 stores information related to each of the individual hanger transport devices 18 in a database (more specifically a table, for example), by storing this information in association with identification information of the hanger transport devices 18. The information related to each of the individual hanger transport devices 18 that has been pre-stored in association with identification information of the hanger transport devices 18 includes, for example, as well as information related to the external profile of the hanger transport device 18 (including dimensional information and the like related to minor distortion), also information about whether or not the hanger transport device 18 has a work set jig 14 hanging therefrom and the external profile of the work set jig 14. This information is configured so as to be updatable as appropriate by a user.

Based on the identification information provided by each of the individual hanger transport devices 18 and the information related to each of the individual hanger transport devices 18 pre-stored in association with the identification information, the control unit 120 controls the various actions of the transfer robots R1, R5, the nozzle holding robots 31, and the blower robot 42R by outputting an operation signal appropriate for each of the plural hanger transport devices 18 to the transfer robots R1, R5, the nozzle holding robots 31, and the blower robot 42R. Namely, the control unit 120 performs fine adjustment for robot teaching. In cases in which the information related to each of the individual hanger transport devices 18 includes information that a particular hanger transport device 18 is hung with a slightly distorted work set jig 14, fine adjustments is performed such that prescribed site of action portions of a robot is shifted by movements of a few millimeters up, down, left, or right with respect to a pre-set position according to the site of distortion and amount of distortion of the work set jig 14.

Based on the identification information provided by each of the individual hanger transport devices 18 and the information related to each of the individual hanger transport devices 18 pre-stored in association with the identification information, the control unit 120 also controls operation of the hanger transport device 18 by outputting to the plural hanger transport devices 18 a control signal that is appropriate to each of the hanger transport devices 18. As an example, in cases in which the information related to each of the individual hanger transport devices 18 includes information that a particular hanger transport device 18 is hung with a work set jig 14 that has been slightly distorted in the transport direction, the control unit 120 performs operation control so as to shift the stopping position of this hanger transport device 18 either toward the transport direction upstream side or toward the transport direction downstream side relative to the pre-set stopping position by a few millimeters according to the site of distortion and amount of distortion of the work set jig 14.

Placement and Projection Range of Projection Machines 32A to 32D

Figure 12A:
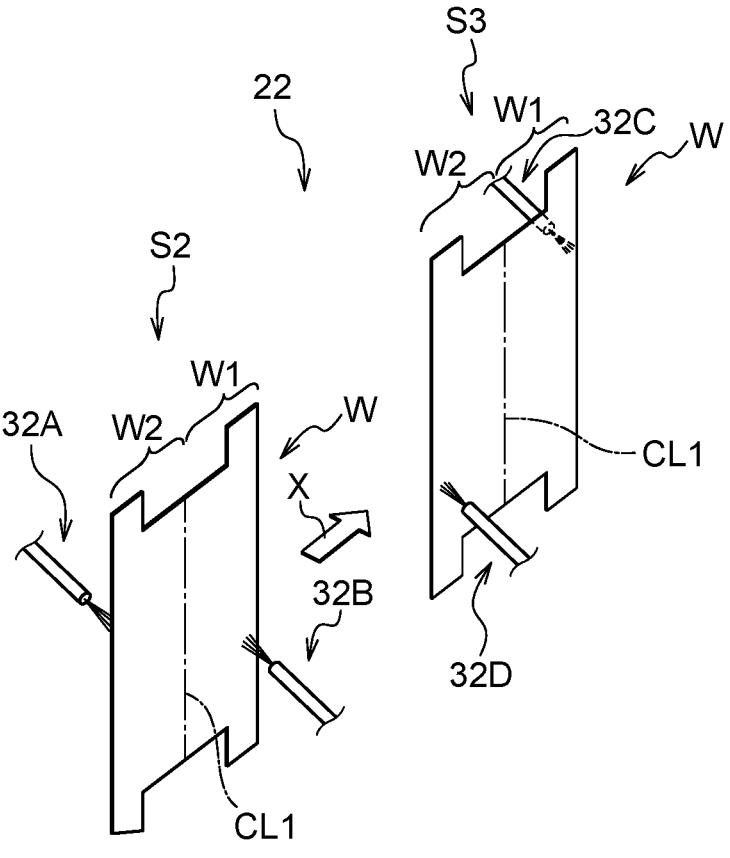
FIG. 12A is a schematic perspective view to explain projection range and the like of each projection machine in the blasting treatment apparatus of FIG. 1.

Explanation next follows regarding the placement of the projection machines 32A to 32D illustrated in FIG. 3 and the projection ranges of each of the projection machines, with reference to FIG. 12A. Note that in the drawings the single-dot broken line CL1 indicates a center line marking a center position of the workpiece W in a direction along the transport path 22. Moreover, in the drawings, the reference sign W1 indicates a front half section range serving as a first half section at one side of the workpiece W in the direction along the transport path 22 (the transport direction downstream side thereof in the present exemplary embodiment), and the reference sign W2 indicates a rear half section range serving as a second half section at the other side of the workpiece W in the direction along the transport path 22 (the transport direction upstream side thereof in the present exemplary embodiment).

The first upstream projection machine 32A and the second upstream projection machine 32B are provided at the first projection station S2. The first upstream projection machine 32A projects projection media from a lateral side in a width direction of the transport path 22 (more specifically from the left side when facing toward the transport direction downstream side), and the second upstream projection machine 32B projects projection media from another lateral side in the width direction of the transport path 22 (more specifically from the right side when facing toward the transport direction downstream side). The first upstream projection machine 32A is configured so as to project the projection media onto the rear half section W2 within the first half section W1 and the rear half section W2 on one side of the workpiece W, and the second upstream projection machine 32B is configured so as to project the projection media onto the front half section W1 within the first half section W1 and the rear half section W2 on another side of the workpiece W.

The first downstream projection machine 32C and the second downstream projection machine 32D are provided at the second projection station S3. The first downstream projection machine 32C projects projection media from a lateral side in the width direction of the transport path 22 (more specifically from the left side when facing toward the transport direction downstream side), and the second downstream projection machine 32D projects projection media from another lateral side in the width direction of the transport path 22 (more specifically from the right side when facing toward the transport direction downstream side). The first downstream projection machine 32C is configured so as to project the projection media onto the first half section W1 within the first half section W1 and the rear half section W2 on the one side of the workpiece W, and the second downstream projection machine 32D is configured so as to project the projection media onto the rear half section W2 within the first half section W1 and the rear half section W2 on the other side of the workpiece W.

In order to inspect whether or not the positional precision of the nozzles 33 moved by the nozzle holding robots 31 is correct in the blasting treatment chamber 30, as illustrated in FIG. 9A, inspection holes 110 are respectively provided at each of the two lateral sides of a length direction intermediate portion of the lower guide rail sections 52L, 53L. An inspection mode is pre-incorporated into a program for operating the nozzle holding robots 31, with the nozzles 33 configured to fall inside the inspection holes 110 if everything is normal when the inspection mode has been executed. In other words, in cases in which the inspection mode is executed but the nozzles 33 do not fall inside the inspection holes 110, some abnormality can be determined to have arisen, such as in the action precision of the nozzle holding robots 31, deformation of the nozzles 33, or the like. Inspection such as this is preferably executed periodically, such as once a week, every day at start up, or the like.

Running of Blasting Treatment Apparatus 10

A brief explanation follows regarding running of the blasting treatment apparatus 10.

First, the dust collector 46 is started up. Then the projection media is filled into the projection media feed box 45, and the circulation device 44 is started up. Then the projection machines 32A to 32D are started up.

Next, one of the hanger transport devices 18 is moved, and the respective work set jig 14 is moved to the loading station S1. Note that in the present exemplary embodiment the hanger transport device 18 is stopped temporarily just before the loading station S1, and then enters into the loading station S1 when confirmed that there is currently no work set jig 14 present in the loading station S1.

Next the transfer positioning unit 80 is operated to fix the rollers 60L of the work set jig 14. Then at the loading station S1, the displacement unit 96 is operated, and the tension spring 94C is raised by raising the abutting member 96B. In this state, the transfer robot R1 sets the workpiece W in the work set jig 14, the displacement unit 96 is operated, and the tension spring 94C is returned to its original state by lowering the abutting member 96B, thereby clamping the workpiece W in the clamp unit 90.

The sliding door 25A on the loading side is next opened. The transfer positioning unit 80 at the loading station S1 is then operated to release the fixing of the rollers 60L of the work set jig 14, and the work set jig 14 is moved to the first projection station S2 by moving the hanger transport device 18. Note that in the present exemplary embodiment the hanger transport device 18 is stopped temporarily just before the loading side of the cabinet 26, then enters the first projection station S2 when confirmed that there is currently no work set jig 14 present in the first projection station S2, and then stops. The projection positioning unit 70 is then operated and the rollers 60L of the work set jig 14 are fixed, and the sliding door 25A on the loading side and the sliding door 25B inside the cabinet 26 are closed. While in this state, projection media is ejected from the first upstream projection machine 32A and the second upstream projection machine 32B, and blasting treatment is performed.

After completion of the blasting treatment at the first projection station S2, the projection positioning unit 70 at the first projection station S2 is operated, and fixing of the rollers 60L of the work set jig 14 is released. The work set jig 14 is then moved to the second projection station S3 by moving the hanger transport device 18 and stopping the hanger transport device 18 at the second projection station S3. The projection positioning unit 70 is then operated to fix the rollers 60L of the work set jig 14. In this state, projection media is ejected from the first downstream projection machine 32C and the second downstream projection machine 32D illustrated in FIG. 3, and blasting treatment is performed.

After completion of the blasting treatment at the second projection station S3, the sliding door 25B inside the cabinet 26 is opened. Then the projection positioning unit 70 at the second projection station S3 is operated, releasing the fixing of the rollers 60L of the work set jig 14. The work set jig 14 is then moved to the air-blow station S4 by moving the hanger transport device 18 to the air-blow station S4 and stopping the hanger transport device 18. The air-blow positioning unit 170 is then operated and the rollers 60L of the work set jig 14 fixed. While in this state, the blower 42 blows gas onto a lower portion of the hanger transport device 18 in the air-blow chamber 40, onto the work set jig 14, and onto the workpiece W, so as to knock off any remaining projection media. This thereby suppresses the projection media from being carried out from the cabinet 26, improving the working environment.

After the gas blowing processing has been completed at the air-blow station S4, the sliding door 25C on the unload side is opened. The air-blow positioning unit 170 at the air-blow station S4 is operated, releasing fixing of the rollers 60L of the work set jig 14. The work set jig 14 is then moved to the unloading station S5 by moving the hanger transport device 18. Note that the hanger transport device 18 in the present exemplary embodiment is stopped temporarily at a position between the cabinet 26 and the unloading station S5 further toward the cabinet 26, enters into the unloading station S5 when confirmed that there is currently no work set jig 14 present at the unloading station S5, and is then stopped. The transfer positioning unit 88 illustrated in FIG. 3 is operated when the work set jig 14 arrives in the unloading station S5, and the rollers 60L of the work set jig 14 are fixed.

At the unloading station S5, first the workpiece W held in the work set jig 14 is grabbed by the transfer robot R5, then the displacement unit 98 illustrated in FIG. 5 is operated in this state, and the tension spring 94C is raised. The transfer robot R5 next takes the workpiece W out from the work set jig 14, and after this is performed the tension spring 94C is returned to its original state by operating the displacement unit 98. Moreover, after gripping the workpiece W, the transfer robot R5 inverts and shakes the workpiece W over the projection media recovery device 29, such that any projection media that has entered into voids in the workpiece W falls out into the projection media recovery device 29. The workpiece W is then unloaded.

Operation and Advantageous Effects of Present Exemplary Embodiment

Explanation next follows regarding the operation and advantageous effects of the exemplary embodiment described above.

In the present exemplary embodiment, the plural hanger transport devices 18 move along the guide path 16 in a hanging state of the work set jig 14 set with the workpiece W, and the hanger transport devices 18 are also able to stop at the loading station S1, the first projection station S2, the second projection station S3, the air-blow station S4, and the unloading station S5.

At the loading station S1, a transfer robot R1 loads the workpiece W as a task in a loading process. Moreover, at the first projection station S2 and the second projection station S3, as a task in a projection process, nozzle holding robots 31 inside the blasting treatment chamber 30 hold nozzles 33 and move leading ends of the nozzles 33 of the projection machines 32A to 32D toward the workpiece W. The projection media projected from the projection machines 32A to 32D accordingly hits a prescribed position on the workpiece W. At the air-blow station S4, as a task in an air-blow process, blower robots 42R in the air-blow chamber 40 hold nozzles 42A and move leading ends of the nozzles 42A toward the workpiece W etc. The air blown from the blower 42 is thereby blown onto a prescribed position on the workpiece W etc. Furthermore, at the unloading station S5, as a task in an unloading process, a transfer robot R5 unloads the workpiece W.

Each of the hanger transport devices 18 is capable of providing identification information for self-identification. The control unit 120 controls operation of the hanger transport device 18 by outputting to each of the plural hanger transport devices 18 a control signal that is appropriate for each of the hanger transport devices 18 based on the identification information provided from each of the individual hanger transport devices 18 and based on information related to each of the individual hanger transport devices 18 stored in advance in association with the identification information. Moreover, the control unit 120 also controls operations of the transfer robots R1, R5, the nozzle holding robot 31, and the blower robot 42R by outputting to the transfer robots R1, R5, the nozzle holding robots 31, and the blower robot 42R an operation signal appropriate to each of the plural hanger transport devices 18 based on the identification information provided from each of the individual hanger transport devices 18 and based on the information related to each of the individual hanger transport devices 18 stored in advance in association with the identification information.

As described above, the blasting treatment apparatus 10 of the present exemplary embodiment is capable of performing blasting treatment appropriate to individual differences between each of the hanger transport devices 18.

Moreover, in the present exemplary embodiment, the first to fifth guide rail sections 51 to 55 are provided along part of the transport path 22 illustrated in FIG. 3 and separate from the guide path 16 illustrated in FIG. 4. The hanger transport device 18 hangs the work set jig 14 equipped with the frame body 12 that the workpiece W is set inside, and the rollers 60L, 60U of the work set jig 14 are guided by the first to fifth guide rail sections 51 to 55. The workpiece W set inside the frame body 12 of the work set jig 14 is accordingly transported more stably.

Moreover, the guide path 16 is equipped with the curved path 16A that is curved in apparatus plan view at the transport direction upstream side of the loading station S1. The left and right pair of first guide rail sections 51 are formed with an entrance corresponding to a terminal end side of the curved path 16A in apparatus plan view and are disposed over a range including the stopping position of the work set jig 14 (the stopping position of the loading station S1). At a timing when one of the hanger transport devices 18 has been detected, by the limit switch LS1 (LS1*a*) arranged in the vicinity of the start end side of the curved path 16A in apparatus plan view, as passing in the vicinity of a placement position of the limit switch LS1 (LS1*a*), a movement velocity V1*a* of this hanger transport device 18 is set to a velocity that enables the rollers 60L, 60U to enter between the left and right pair of first guide rail sections 51 even if the work set jig 14 sways under centrifugal force. The workpiece W is accordingly transported and stopped stably even with the curved path 16A provided at the transport direction upstream side of the loading station S1.

Moreover, the guide path 16 is equipped with the curved path 16C that is curved in apparatus plan view at the transport direction upstream side of the unloading station S5. The left and right pair of fifth guide rail sections 55 are formed with an entrance corresponding to a terminal end side of the curved path 16C in apparatus plan view and are disposed over a range including the stopping position of the work set jig 14 (the stopping position of the unloading station S5). At a timing when one of the hanger transport devices 18 has been detected, by the limit switch LS1 (LS1*b*) disposed in the vicinity of the start end side of the curved path 16C in apparatus plan view, as passing in the vicinity of a placement position of the limit switch LS1 (LS1*b*), a movement velocity V1*b* of this hanger transport device 18 is set to a velocity that enables the rollers 60L, 60U to enter between the left and right pair of fifth guide rail sections 55 even if the work set jig 14 sways under centrifugal force. The workpiece W is accordingly transported and stopped stably even with the curved path 16C provided at the transport direction upstream side of the unloading station S5.

Moreover, in the exemplary embodiment described above, the limit switches LS2 are arranged at the transport direction upstream side of the stations S1 to S5 at which the hanger transport device 18 is stopped and at which the work set jig 14 is positioned. At a timing when the hanger transport device 18 has been detected by the limit switch LS2 as passing in the vicinity of the placement position of the limit switch LS2, the movement velocity of the hanger transport device 18 is set by the control unit to the movement velocity V2. The movement velocity V2 is lower than the movement velocities V1*a*, V1*b* set at the timing when the hanger transport device 18 was detected by the limit switch LS1 as passing in the vicinity of the placement position of the limit switch LS1. This accordingly enables the work set jig 14 illustrated in FIG. 5, and the workpiece W set inside the work set jig 14, to be stopped with good precision when the hanger transport device 18 is stopped.

Moreover, in the above exemplary embodiment, an acceleration limit switch LS3 is arranged in a region of the transport path 22 at which the work set jig 14 is transported in a state in which there is no workpiece W set inside the work set jig 14, and at the transport direction upstream side of the straight line portion 22L in apparatus plan view. At a timing when the hanger transport device 18 has been detected by the acceleration limit switch LS3 as passing in the vicinity of the placement position of the limit switch LS3, the movement velocity of the hanger transport device 18 is set by the control unit to a movement velocity V3. The movement velocity V3 is higher than the movement velocities V1*a*, V1*b* set at the timing when the hanger transport device 18 was detected by the limit switch LS1 as passing in the vicinity of the placement position of the limit switch LS1. The cycle time is accordingly shortened.

MODIFIED EXAMPLES

Figure 12B:
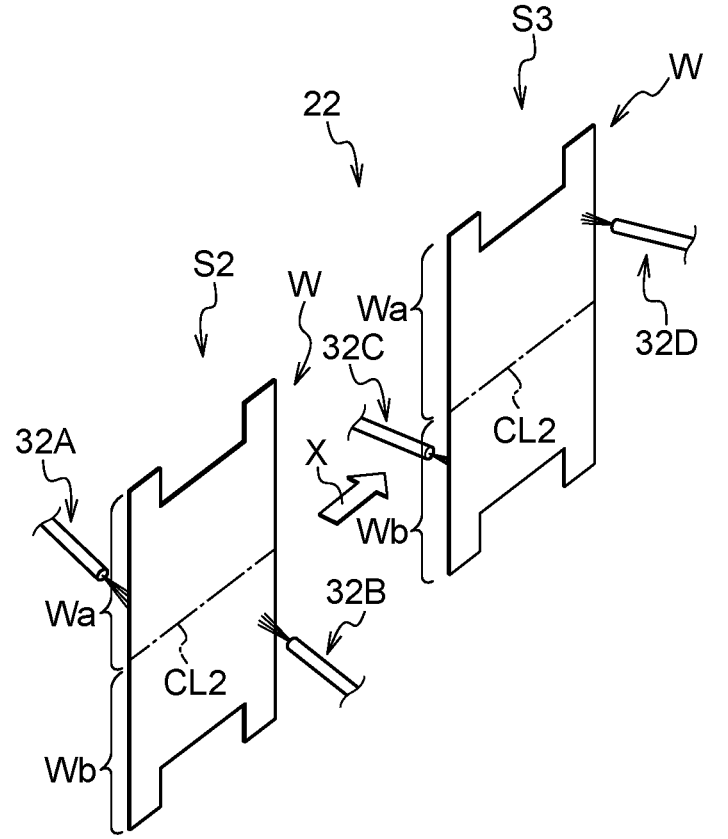
FIG. 12B is a schematic perspective view to explain projection range and the like of each projection machine according to a modified example.

Explanation follows regarding a modified example of the above exemplary embodiment, with reference to FIG. 12B. Note that in the drawings the single-dot broken line CL2 indicates a center line marking a center position of the workpiece W in the apparatus vertical direction. In the drawings the reference sign Wa indicates an upper half section range serving as a first half section of the workpiece W in the apparatus vertical direction, and the reference sign Wb indicates a lower half section range serving as a second half section of the workpiece W in the apparatus vertical direction.

In the modified example the first upstream projection machine 32A projects the projection media onto the upper half section Wa within the upper half section Wa and the lower half section Wb on one side of the workpiece W, and the second upstream projection machine 32B projects the projection media onto the lower half section Wb within the upper half section Wa and the lower half section Wb on another side of the workpiece W. The first downstream projection machine 32C projects the projection media onto the lower half section Wb within the upper half section Wa and the lower half section Wb on the one side of the workpiece W, and the second downstream projection machine 32D is configured so as to project the projection media onto the upper half section Wa within the upper half section Wa and the lower half section Wb on the other side of the workpiece W.

The cycle time can also be shortened by this modified example. Note that as another modified example, a configuration may be adopted in which the projection ranges at the first projection station S2 illustrated in FIG. 12A are swapped around with the projection ranges at the second projection station S3 therein, and a configuration may be adopted in which the projection ranges at the first projection station S2 illustrated in FIG. 12B are swapped around with the projection ranges at the second projection station S3.

Supplementary Explanations Regarding Exemplary Embodiment

Note that as a modified example of the exemplary embodiment described above, the hanger transport device may be capable of moving along the guide path and stopping with the workpiece (W) in a directly hanging state.

Moreover, although in the above exemplary embodiment, identification information to identify the hanger transport device 18 is provided from the hanger transport device 18 to the control unit 120 by the identification information provider section 18S of the hanger transport device 18 illustrated in FIG. 13A contacting the limit switches LSa to LSd, a configuration may be adopted in which, for example, the identification information is provided from the hanger transport device 18 to the control unit 120 by an identification information code for self-identification using a laser marker or the like is pre-applied at an upper end portion of the hanger transport device 18 of. In this case the identification information code is read using a code reader.

Moreover, although in the present exemplary embodiment, there are the three stations Swa, Swb, Swc provided for temporarily stopping the hanger transport devices 18 on standby, in addition to these three, for example, a station at which the hanger transport device 18 can be temporarily stopped on standby may also be provided at a rear side of the apparatus from the first projection station S2 on the transport direction upstream side of the station Swa.

Moreover, instead of the limit switches LS1, LS2, LS3 of the above exemplary embodiment another detection member may be applied, such as, for example, an infrared sensor or the like.

The control of the movement velocity of the hanger transport device 18 is preferably performed as in the example of the above exemplary embodiment, however, it may, for example, be set to a constant low velocity (a velocity equivalent to the movement velocity V2 as an example).

Moreover, although in the above exemplary embodiment a shot processing apparatus is configured by the blasting treatment apparatus 10 including the air pressure projection machines 32A to 32D illustrated in FIG. 3 etc., the shot processing apparatus may be a shot processing apparatus including centrifugal projection machines, or may be a shot peening apparatus including either air pressure projection machines or centrifugal projection machines. Moreover, the shot processing apparatus may be an apparatus to perform both blasting treatment and shot peening. A projection chamber at which shot peening treatment is performed is a shot peening treatment chamber.

Moreover, although in the above exemplary embodiment the clamp mechanism 90 illustrated in FIG. 8 is configured including the tension spring 94C as the elastic mechanism, the clamp mechanism may however, for example, be configured including a holding member that holds a workpiece (W) set inside the frame body (12) (between the upper and lower pair of cross members (12A, 12B)) using another elastic mechanism, such as a compression spring or the like, to urge a workpiece (W) set inside the frame body (12) (between the upper and lower pair of cross members (12A, 12B)).

Moreover, as another modified example of the above exemplary embodiment, the clamp mechanism may be configured including a cylinder (electrically operated cylinder or air cylinder) as a mechanism to hold a workpiece (W) set inside the frame body (12) (between the upper and lower pair of cross members (12A, 12B)). In such cases, for example, a configuration may be adopted such as one achieved by repurposing the pressing mechanism 72 in FIG. 9A to FIG. 9C. Moreover, in cases in which an electrically operated cylinder is applied in such a modified example, the electrically operated cylinder may, for example, be supplied with power from a bus duct (electrical power main line) 21 provided along the rail 20.

Moreover, as another modified example of the above exemplary embodiment, instead of the clamp mechanism 90 illustrated in FIG. 8, the applied clamp mechanism may be configured including bolts for holding arranged with axial directions along the apparatus up-down direction, so as to fix the workpiece (W) by clamping between the upper and lower pair of cross members (12A, 12B).

Moreover, as another modified example of the above exemplary embodiment, instead of the frame body 12 illustrated in FIG. 8, another base member may be applied, such as a base member having a reclining H-shape when viewed in the same direction as FIG. 8. As for such a base member having a reclining H-shape, the base member is configured including an upper and lower pair of cross members arranged facing each other, and a vertical member connecting length direction (left-right direction) intermediate portions of the upper and lower pair of cross members together, so that a workpiece can be set between the upper and lower pair of cross members.

Moreover, although in the above exemplary embodiment the displacement mechanisms 96, 98 illustrated in FIG. 5 and FIG. 11 are provided to release holding by the holding section 94 of the clamp mechanism 90, and such a configuration is preferable, a configuration lacking the displacement mechanisms 96, 98 may be adopted as a modified example of the above exemplary embodiment. In such cases, for example, holding by the pressing portion 94 of the clamp mechanism 90 may be released by hand or the like.

Moreover, although in the above exemplary embodiment the work set jig 14 includes the rollers 60L, 60U serving as the guided section guided by the first to fifth guide rail sections 51 to 55 serving as rail-shaped guide sections illustrated in FIG. 3 etc., as a modified example of the above exemplary embodiment, a work set jig includes as a guided section guided by rail-shaped guide sections, for example, a guided section other than such rollers, such as a slider or the like that is slidably guided by a guide section.

Moreover, as a modified example of the above exemplary embodiment, a positioning unit may, for example, include an engagement indentation, an engagement protrusion, and a drive section, those are provided separately from a guided section that is in turn provided separately from a work set jig. The engagement indentation is employed for positioning and stopping. The engagement protrusion is engagable with the engagement indentation and is capable of moving between an engaged position engaged with the engagement indentation and a non-engaged position separated from the engagement indentation. The drive section moves the engagement protrusion between the engaged position and the non-engaged position. In such a mechanism, the engagement protrusion is engaged with the engagement indentation under operation of the drive section so as to position the work set jig at the stopping position in the blasting treatment chamber.

Moreover, although in the above exemplary embodiment, the first to fifth guide rail sections 51 to 55 serving as the rail-shaped guide sections are provided along part of the transport path 22 and such a configuration is preferable from the perspective of securing work space, a configuration may also be adopted in which the rail-shaped guide sections are provided along the entire length of the transport path (22).

Moreover, although in the above exemplary embodiment the pressing section 72 provided in the blasting treatment chamber 30 is equipped with the drive cylinder 73, the bar shaped member 74, the covers 76A, 76B, 76C, 76D, the shaft member 77, and the pressing members 78, and such a configuration is preferable, as a modified example of the above exemplary embodiment, a pressing section provided in the blasting treatment chamber (30) may, for example, be a mechanism configured such as by repurposing the pressing section 82 illustrated in FIG. 10A and FIG. 10B.

Moreover, although in the above exemplary embodiment, the transfer positioning mechanisms 80 88 are provided for positioning at the stopping positions in the loading station S1 and the unloading station S5, and such a configuration is preferable, a configuration lacking the transfer positioning mechanisms 80, 88 may be adopted. Moreover, although in the above exemplary embodiment the transfer robots R1, R5 are provided in the loading station S1 and the unloading station S5, and such a configuration is preferable, a configuration lacking the transfer robots R1, R5 may also be adopted.

Moreover, although in the above exemplary embodiment, two stations, i.e. the first projection station S2 and the second projection station S3, are provided as the projection station, and such a configuration is preferable, the projection station may be configured by a single station.

Moreover, as a modified example of the present exemplary embodiment, a loading-unloading station may be employed as a common transfer station employed as both the loading station S1 and the unloading station S5.

Moreover, although in the above exemplary embodiment the nozzle 42A of the blower 42 is held by the leading end portion of the blower robot 42R, as a modified example, a configuration may be adopted in which a nozzle of a blower is fixed.

Note that an appropriate combination may be implemented to combine the above exemplary embodiment with the above modified example(s).

Although an example of the present invention has been explained, the present invention is not limited to the above, and obviously various modifications may be implemented within a range not departing from the scope of the present invention.

The entire content of the disclosure of Japanese Patent Application No. 2018-058023 filed on Mar. 26, 2018 is incorporated by reference in the present specification.

The invention claimed is:

1. A shot processing apparatus, comprising:

a projection machine configured to project projection media onto a workpiece;

a plurality of hanger transport devices, each of which, in a hanging state of a member on which a workpiece is set or a hanging state of a workpiece, is movable along a guide path inside the shot processing apparatus, is stoppable, and is configured to provide self-specifying identification information; and a control unit configured to control operation of the hanger transport devices by outputting, to each of the plurality of hanger transport devices, a control signal that is appropriate to each of the hanger transport devices based on the identification information provided from each of the individual hanger transport devices and based on information related to each of the individual hanger transport devices, the information being stored in advance in association with the identification information, wherein the information, which is related to each of the individual hanger transport devices and which is stored in advance in association with the identification information comprises an external profile of a hanger transport device, and whether or not a hanger transport device has a work set jig hanging therefrom and an external profile of the work set jig.

2. The shot processing apparatus of claim 1, comprising:

a robot that is provided separately from the hanger transport devices and that performs a task in a process for shot processing, wherein the control unit is configured to control operation of the robot by outputting, to the robot, an operation signal that is appropriate for each of the plurality of hanger transport devices based on the identification information provided from each of the individual hanger transport devices and based on the information related to each of the individual hanger transport devices, the information being stored in advance in association with the identification information.

3. The shot processing apparatus of claim 2, wherein the robot comprises a transfer robot that performs at least workpiece loading or workpiece unloading at a transfer station at which the hanger transport device is stopped and at which the workpiece loading or the workpiece unloading is performed.

4. The shot processing apparatus of claim 2, wherein:

the projection machine is an air pressure projection machine in which air that has been pressurized is mixed with the projection media and the mixture is ejected from a nozzle; and the robot comprises a nozzle holding robot that holds the nozzle and moves a leading end of the nozzle toward the workpiece.

5. The shot processing apparatus of claim 2, wherein:

the hanger transport devices are movable along the guide path while in a hanging state of the work set jig including a frame body for accommodating a workpiece;

the guide path includes a curved path that is curved in apparatus plan view;

the shot processing apparatus further comprises a rail-shaped guide section that is separate from the guide path and that is provided along a part of a transport path along which a workpiece is transported by movement of the hanger transport devices;

the work set jig includes a guided section that is guided by the guide section;

the rail-shaped guide section includes a left and right pair of stopping area guide sections that have an entrance corresponding to a terminal end side of the curved path in apparatus plan view and the stopping area guide sections are disposed over a range including a stopping position of the work set jig; and the control unit is configured to set a movement velocity of the hanger transport devices, at a timing at which the hanger transport devices have been detected by a detection member as passing in a vicinity of a placement position of the detection member, the detection member being arranged in a vicinity of a start end side of the curved path in apparatus plan view, to a movement velocity that enables the guided section to enter between the left and right pair of stopping area guide sections even in a case in which the work set jig sways under centrifugal force.

6. The shot processing apparatus of claim 5, wherein:

the detection member comprises a first detection member;

the movement velocity set by the control unit at the timing at which the hanger transport devices have been detected by the first detection member is a first movement velocity;

the control unit is configured to set a movement velocity of the hanger transport devices, at a timing at which the hanger transport devices have been detected by a second detection member as passing in a vicinity of a placement position of the second detection member, to a second movement velocity;

the second detection member is arranged at a transport direction upstream side of a station at which the hanger transport devices stop and at which the work set jig is positioned by a positioning mechanism; and the second movement velocity is lower than the first movement velocity.

7. The shot processing apparatus of claim 5, wherein:

the detection member comprises a first detection member;

the movement velocity set by the control unit at the timing at which the hanger transport devices have been detected by the first detection member is a first movement velocity;

the control unit is configured to set a movement velocity of the hanger transport devices to a second movement velocity at a timing at which the hanger transport device has been detected by a second detection member as passing in a vicinity of a placement position of the second detection means;

the second detection member is arranged so as to correspond to a transport direction upstream side of a straight line section of the transport path in apparatus plan view, the work set jig being transported in a state in which there is no workpiece set inside the work set jig at the straight line section; and the second movement velocity is higher than the first movement velocity.

8. A shot processing apparatus, comprising:

a projection machine configured to project projection media onto a workpiece;

a plurality of hanger transport devices, each of which, in a hanging state of a member on which a workpiece is set or a hanging state of a workpiece, is movable along a guide path inside the shot processing apparatus, is stoppable, and is configured to provide self-specifying identification information; and a control unit configured to control operation of the hanger transport devices by outputting, to each of the plurality of hanger transport devices, a control signal that is appropriate to each of the hanger transport devices based on the identification information provided from each of the individual hanger transport devices and based on information related to each of the individual hanger transport devices, the information being stored in advance in association with the identification information, wherein:

the hanger transport devices are movable along the guide path while in a hanging state of a work set jig including a frame body for accommodating a workpiece;

the guide path includes a curved path that is curved in apparatus plan view;

the shot processing apparatus further comprises a rail-shaped guide section that is separate from the guide path and that is provided along a part of a transport path along which a workpiece is transported by movement of the hanger transport devices;

the work set jig includes a guided section that is guided by the guide section;

the rail-shaped guide section includes a left and right pair of stopping area guide sections that have an entrance corresponding to a terminal end side of the curved path in apparatus plan view and the stopping area guide sections are disposed over a range including a stopping position of the work set jig; and the control unit is configured to set a movement velocity of the hanger transport devices, at a timing at which the hanger transport devices have been detected by a detection member as passing in a vicinity of a placement position of the detection member, the detection member being arranged in a vicinity of a start end side of the curved path in apparatus plan view, to a movement velocity that enables the guided section to enter between the left and right pair of stopping area guide sections even in a case in which the work set jig sways under centrifugal force.

9. The shot processing apparatus of claim 8, wherein:

the detection member comprises a first detection member;

the movement velocity set by the control unit at the timing at which the hanger transport devices have been detected by the first detection member is a first movement velocity;

the control unit is configured to set a movement velocity of the hanger transport devices, at a timing at which the hanger transport devices have been detected by a second detection member as passing in a vicinity of a placement position of the second detection member, to a second movement velocity;

the second detection member is arranged at a transport direction upstream side of a station at which the hanger transport devices stop and at which the work set jig is positioned by a positioning mechanism; and the second movement velocity is lower than the first movement velocity.

10. The shot processing apparatus of claim 8, wherein:

the detection member comprises a first detection member;

the movement velocity set by the control unit at the timing at which the hanger transport devices have been detected by the first detection member is a first movement velocity;

the control unit is configured to set a movement velocity of the hanger transport devices to a second movement velocity at a timing at which the hanger transport device has been detected by a second detection member as passing in a vicinity of a placement position of the second detection means;

the second detection member is arranged so as to correspond to a transport direction upstream side of a straight line section of the transport path in apparatus plan view, the work set jig being transported in a state in which there is no workpiece set inside the work set jig at the straight line section; and the second movement velocity is higher than the first movement velocity.

* * * * *